US006017400A

United States Patent [19]

Clark et al.

[11] Patent Number: 6,017,400

[45] Date of Patent: Jan. 25, 2000

[54] METHOD AND SYSTEM FOR CLEANING A WATER BASIN FLOOR

[75] Inventors: Andrew M. Clark; Jerry Neely, both of Vero Beach; John Holt, Ft. Pierce, all of Fla.; Marc Lopata, Downers Grove, Ill.; Allan Flowers, Ruskin, Fla.; Michio Miyake, Anaheim, Calif.

[73] Assignee: Orange County Water District, Fountain Valley, Calif.

[21] Appl. No.: 09/079,964

[22] Filed: May 15, 1998

Related U.S. Application Data

[60] Provisional application No. 60/046,531, May 15, 1997.

[51] Int. Cl.[7] ..... E04H 4/16

[52] U.S. Cl. ..... 134/21; 15/1.7; 210/169; 210/416.2

[58] Field of Search ..... 15/1.7; 134/21; 210/143, 169, 406, 416.2

[56] References Cited

U.S. PATENT DOCUMENTS

| | | |
|---|---|---|
| 516,066 | 3/1894 | Titcomb . |
| 3,160,966 | 12/1964 | Skakel . |
| 3,585,740 | 6/1971 | Koning et al. . |
| 3,738,029 | 6/1973 | Harmon . |
| 3,919,790 | 11/1975 | Sasaki et al. . |
| 4,053,181 | 10/1977 | Saito . |
| 4,386,473 | 6/1983 | Amann et al. . |
| 4,391,468 | 7/1983 | Funk . |
| 4,575,960 | 3/1986 | Deal . |
| 4,849,024 | 7/1989 | Supra . |
| 4,942,682 | 7/1990 | McDowell . |
| 4,943,186 | 7/1990 | Van Weezenbeek . |
| 5,027,533 | 7/1991 | Holt et al. . |
| 5,203,099 | 4/1993 | Naranjo et al. . |
| 5,245,723 | 9/1993 | Sommer . |
| 5,285,587 | 2/1994 | Krenzler . |
| 5,306,183 | 4/1994 | Holt et al. . |
| 5,412,826 | 5/1995 | Raubenheimer . |
| 5,542,141 | 8/1996 | Albright . |

FOREIGN PATENT DOCUMENTS

| | | |
|---|---|---|
| 2584442 | 1/1987 | France . |
| 2685374 | 6/1993 | France . |
| 54-56252 | 5/1979 | Japan . |

*Primary Examiner*—Terrence R. Till
*Attorney, Agent, or Firm*—Knobbe, Martens, Olson & Bear, LLP

[57] ABSTRACT

A method and system for cleaning an underwater floor is disclosed. The method includes: submerging a self-propelled underwater vehicle into a body of water, such as a basin, for example; directing the vehicle to traverse the basin floor; suctioning sediment particles from the basin floor as the vehicle traverses the floor; and providing a suction force to the vehicle. In one embodiment, the act of suctioning includes removing substantial amounts of particles smaller than a predetermined size from the floor while not removing substantial amounts of particles larger than the predetermined size from the floor. The system includes: the submersible, self-propelled vehicle for traversing the underwater floor; a first vacuum hood, coupled to the vehicle, for suctioning sediment particles from the underwater floor; and a first pump, coupled to the hood, for providing a suction force to the hood. In one embodiment, the first vacuum hood is configured to remove substantial amounts of particles smaller than a predetermined size from the floor while not removing substantial amounts of particles larger than the predetermined size from the floor.

45 Claims, 13 Drawing Sheets

METHOD AND SYSTEM FOR CLEANING A WATER BASIN FLOOR

RELATED APPLICATIONS

This application claims priority to a U.S. provisional patent application entitled, "Continuous Basin Cleaning Device," application serial No. 60/046,531, filed on May 15, 1997.

BACKGROUND OF THE INVENTION

1. Field of the Invention

The Present invention relates to a method and apparatus for cleaning a water basin floor. More particularly, the invention relates to an underwater basin cleaning vehicle which removes a clogging layer of debris and growth from the bottom floor of the basin, without removing substantial amounts of sand and/or gravel material residing underneath and mixed with the clogging layer.

2. Description of the Related Art

Many governmental organizations, or entities, own and operate water retrieval and purification systems, otherwise known as basins, for the purpose of supplying the water demands of a respective town, city or county. For example, the Orange County, California, Water District (OCWD) owns and operates seven basins within the Santa Ana River in Anaheim, Calif. These basins are between 10 and 60 feet deep with individual surface areas of between 11 and 71 acres, for a total of over 8,000 acre-feet of surface-storage capacity.

In Orange County, water from the Santa Ana River is conveyed into the basins through a system of pipelines, channels, and settling lagoons. The water in the basins filters through a bottom layer composed mostly of sand and gravel. The water "percolates" through the bottom sand layer and into an underlying aquifer where it is stored for subsequent consumption. Aquifers are large underground formations which are typically filled with porous gravel and rock materials. The water is stored in the "pores" of the aquifer from which it can be pumped to be retrieved and consumed. In Northern Orange County, California, for example, aquifers supply up to 75% of the drinking water needs for that region. Except during storm events when water is lost to the Pacific Ocean, the entire flow of the Santa Ana River is captured for the benefit of the community.

The natural sand and gravel at the bottom of the basins is coarse to very coarse, with a median grain size of 0.9 millimeters, or 90 microns. These coarse particles assist in the filtration of the basin water as it percolates through to the underlying aquifers. It has been observed that percolation rates in the basins drop dramatically after the basins have been in use for several weeks. Samples taken from the basins indicate that this is primarily due to the accumulation of fine sediment and biological growth on the basin floor. This fine sediment and biological growth which forms a "clogging layer," prevents the water in the basins from percolating through the underlying sand layer and into the underground aquifers. Therefore, percolation into the aquifer is impeded. As used herein, the terms "sediment," "sediment particles," "clogging layer," "fine particles" and any combinations or conjugations thereof are used synonymously and interchangeably, and refer to any debris, matter, substance, chemical, biological growth, or other material which may be found on the floor of a body of water and which typically exhibits smaller particle size than the natural sand found on the underwater floor.

Because the basins are above the water table, there are times when the soils below the basins are unsaturated. This condition exacerbates the bottom-clogging phenomenon because the pressure differential between the total head in the basin (20–40 psi) and the atmospheric pressure in the underlying soils (15 psi) tends to compress the intervening sediments. In the case of the clogging material, it is suspected that the pressure compresses the fine particles and the algae into a thin, dense, and relatively impermeable layer on the natural sandy basin floor.

Prior methods of cleaning this layer of clogging material from the basin floor include regularly draining the basins and mechanically scraping away and removing the clogging layer with earth-moving equipment, such as a bulldozer. This process temporarily increases the percolation rates for the basins. However, the clogging layer typically reforms within several weeks and the cleaning process must be repeated. This drain-and-scrape cleaning method requires substantial manpower and necessitates that the basins remain out of service for several days to weeks during the process.

Additionally, these prior methods of removing the clogging layer also removed some of the underlying sand layer which is vital to the natural filtration process of the water. Ideally, the scraped materials would consist of only the fine particles and biological growth which constitute the clogging layer, with little of the underlying natural sand. However, it is difficult to achieve this objective because it is difficult to remove all of the clogging material without removing a large portion of the underlying native sand. Furthermore, over time and with repeated dry-cleaning operations, the silt and clay tend to winnow downward as much as several feet beneath the bottom sand surface of the basin, detrimentally affecting the natural filtration process provided by the sand.

In view of the above-described problems, what is needed is a method and system for removing the clogging materials from the bottom surface of a basin without draining the basin, and without removing substantial amounts of the underlying sand which is needed to filter the water as it percolates through to the underlying aquifer.

SUMMARY OF THE INVENTION

The invention addresses the above and other needs by providing a method and system in which a submersible basin cleaning vehicle is controlled to traverse an underwater floor and selectively remove the finer clogging layer particles without removing a substantial amount of the underlying natural sand and gravel.

In one embodiment of the invention, a system for cleaning an underwater floor, includes: a submersible vehicle for traversing the underwater floor; a first vacuum hood, coupled to the vehicle, for suctioning sediment particles from the underwater floor; and a first pump, coupled to the hood, for providing a suction force to the hood. In another embodiment, the first vacuum hood is configured to remove substantial amounts of particles smaller than a predetermined size from the floor without removing substantial amounts of particles larger than the predetermined size from the floor.

The system further includes: a navigational system, coupled to the submersible vehicle, for indicating the location of the vehicle; and a remote control console, coupled to the navigational system and the submersible vehicle, for receiving vehicle position data from the navigational unit and controlling the movement of the vehicle.

The underwater basin cleaning vehicle includes: a chassis having a front portion, a rear portion and two side portions; an archimedean screw rotor, rotatably coupled to the chassis for providing mobility to the vehicle; and a first vacuum hood, coupled to the chassis.

The system for cleaning an underwater floor, includes: a submersible, self-propelled vehicle for traversing the underwater floor; a first suctioning means, coupled to the submersible vehicle, for suctioning sediment particles from the underwater floor; and a first pump means, coupled to the first suctioning means, for providing a suction force to the first suctioning means.

In a further embodiment, an underwater basin cleaning vehicle, includes: means for providing mobility to the vehicle on a basin floor; a first suctioning means for suctioning sediment particles from the basin floor; and a second suctioning means for suctioning sediment particles from the basin floor, wherein as the vehicle is moving in a forward direction, the first suctioning means is activated, and as the vehicle is moving in a reverse direction, the second suctioning means is activated.

In a further embodiment of the invention, a method of cleaning a basin floor, includes: submerging a self-propelled underwater vehicle into the basin; directing the vehicle to traverse the basin floor; suctioning sediment particles from the basin floor as the vehicle traverses the floor; and providing a suction force to the vehicle. In one embodiment the act of suctioning removes substantial amounts of particles smaller than a predetermined size from the floor while not removing substantial amounts of particles larger than the predetermined size from the floor.

DETAILED DESCRIPTION OF THE INVENTION

The invention is described in detail below with reference to the figures wherein like elements are referenced with like numerals throughout.

Figure 1:
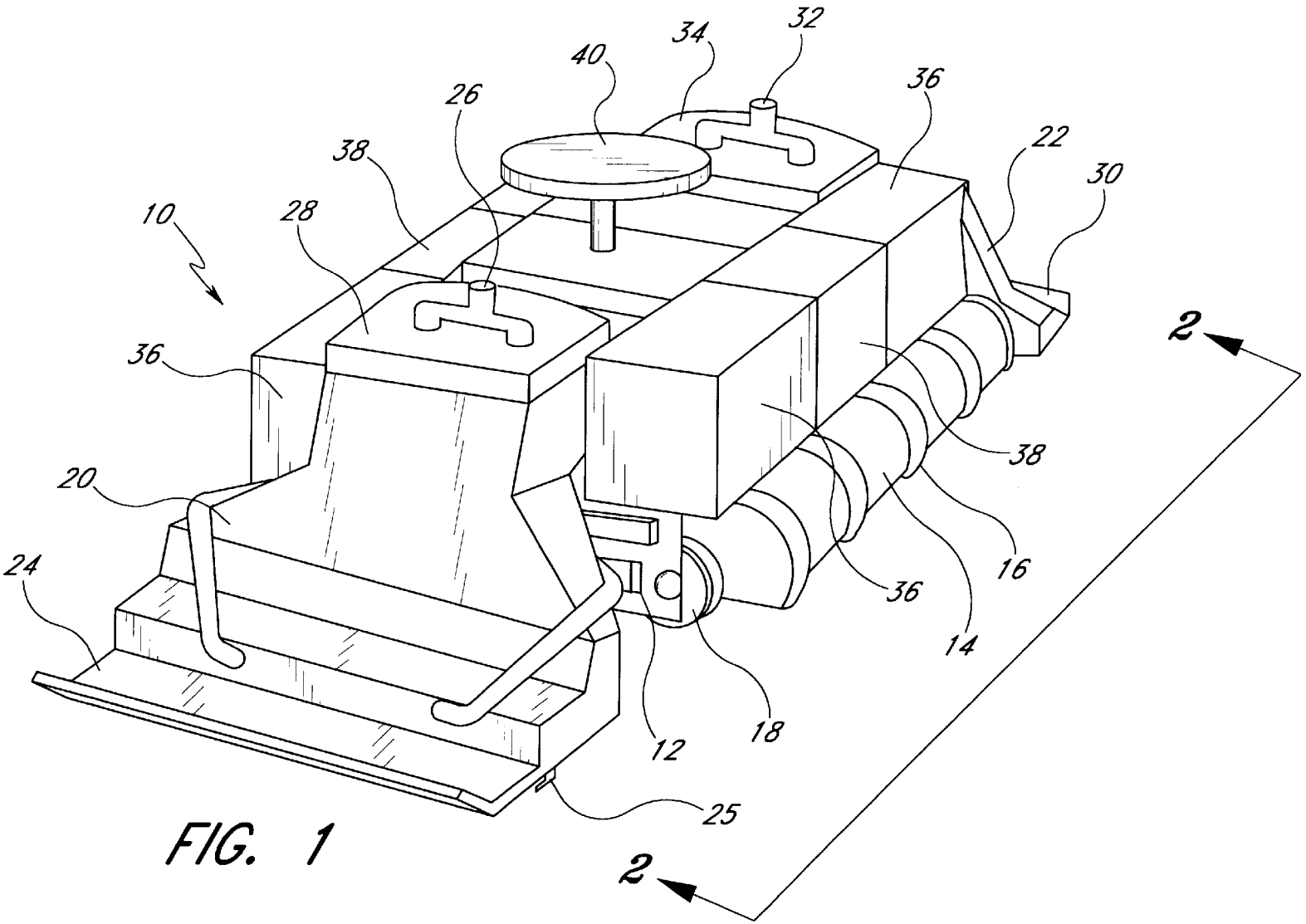
FIG. 1 illustrates a perspective view of a basin cleaning vehicle in accordance with one embodiment of the invention.

FIG. 1 illustrates a perspective view of a basin-cleaning vehicle (BCV) 10 in accordance with one embodiment of the invention. The BCV 10 includes an underlying chassis 12 and two rotating archimedean screw rotors 14, each coupled to the chassis 12 along respective side portions of the chassis 12. Each of the archimedean screw rotors 14 have a set of helix blades 16 which spiral around the longitudinal circumference of the rotors 14. As described in greater detail below with respect to FIG. 3, each rotor 14 is coupled at its ends to the chassis 12 by rotor bearing housings 18 which allow the rotors 14 to rotate about their longitudinal axes in either direction. The rotors 14 are driven by respective motors (not shown) which are coupled to the bearing housings 18 via respective drive belts (not shown).

The propulsion of the BCV 10 is provided by the rotation of the two archimedean screw rotors 14. This propulsion system, otherwise known as the archimedean screw tractor (AST) drive system, allows the BCV 10 to move forward, backward and translate sideways, and turn around in its own length while underwater. The AST drive system further allows the BCV 10 to motivate on the surface of the water, move up a 30 degree slope and exhibit limited maneuverability on dry land. By counter-rotating the rotors 14 in opposite directions, the BCV 10 can be made to move either forward or backward. By simultaneously rotating the rotors in the same direction, the BCV 10 can be made to move laterally either to the left or to the right. The operating principles of archimedean screw rotors 14 are well-known in the art and, therefore, need not be further described here.

The BCV 10 further includes a first vacuum suction hood 20 coupled to a front portion of the chassis 12 and a second vacuum suction hood 22 coupled to a rear portion of the chassis 12. When the BCV 10 is moving in a forward direction, the first vacuum suction hood 20 is lowered to meet the bottom surface being traversed by the BCV 10 and the second vacuum suction hood 22 is raised such that it is elevated above the bottom surface. The first vacuum suction hood 20 includes a first wear plate 24 coupled to the bottom, leading portion of the hood 20. This first wear plate 24 clears the BCV's path of any large objects and smoothes large surface irregularities in this path, thereby "grooming" a path for the first hood 20 to smoothly traverse. A first plurality of rake tines 25 are coupled to the first hood 20 and are located laterally across the bottom of the first hood 20. As will be described in further detail below with reference to FIG. 8*a*, this plurality of rake tines 25 agitates and fluidizes clogging layer sediments resting on the bottom surface. These sediments are then subsequently suctioned upwardly through an opening (not shown) located at the bottom of the first hood 20, into a chamber (not shown) within the first hood 20, and finally toward the top of the first hood 20. The suction force is provided by a slurry pump (not shown) which is coupled to a first hood outlet valve 26 attached to and extending outwardly from a first hood cover 28. The first hood cover 28 seals the top of the first hood 20.

When The BCV 10 is moving in the reverse direction, the second vacuum suction hood 22 is lowered and functions in the same way as described above for the first vacuum suction hood 20. As shown in FIG. 1, the second hood 22 also includes a second wear plate 30 and a second outlet valve 32 which extends outwardly from a second hood cover 34.

The BCV 10 is statically and dynamically stable when it is operating on the water surface, unaided by the support of a solid surface underneath the rotors 14. It Likewise, the BCV 10 is stable when it is transitioning from the surface-swim mode to operating on the bottom-slope. This is accomplished by positioning the BCV 10 weight (center of gravity) as low as possible, and positioning the buoyancy (center of buoyancy) as high as possible, so that the center of gravity is below the center of buoyancy. At the same time, the BCV 10 should maintain "ground" clearance and its buoyancy should not be carried so high as to limit the depth of water in which the BCV 10 can work or float. In order to accomplish this, all heavy components are mounted as low as possible on the BCV 10. In one embodiment, all components are mounted below the center line of the rotors 14 with the exception of a drive gear on the end of the rotor 14 (this drive gear is approximately 6 inches in diameter such that it extends 3 inches below the rotor center line). This prevents disturbance of the bottom and damage to low-mounted equipment should the BCV 10's bottom submergence increase in any soft sand areas.

As shown in FIG. 1, the BCV 10 has both fixed floatation units 36 and variable floatation tanks 38 to control underwater weight and stability in all operating conditions. The upper framework of the chassis 12 supports the fixed floatation units 36 as well as the hard-walled flotation tanks 38. The BCV 10 further carries all the components necessary to adjust BCV 10 weight from an operator's remote control console. The fixed floatation units 36 are removable to allow access to components mounted on the chassis 12. In one embodiment, the fixed floatation units are comprised of closed-cell syntactic foam fabricated into shaped blocks to fit the BCV 10. The volume of foam installed depends on the desired underwater working weight for the BCV 10.

The variable-buoyancy system uses two rigid tanks 38 attached to each side of the BCV 10. In one embodiment, the tanks 38 each have separate vent and flood valves to control air flow into, and water flow out of, the tanks 38. Air flow into and out of the tanks 38 may be controlled by attaching an air supply line (not shown) via a control valve (not shown) to each of the tanks. The control valves may be either electronically controlled or pneumatically controlled and may be conventional off the shelf components which are well-known in the art. In one embodiment, the onboard buoyancy tanks 38 are welded aluminum structures. For simplicity and to minimize the operator workload, the variable-buoyancy system is normally controlled by a limited command set, purge or inflate.

One of the first steps of a basin cleaning operation is to insert the BCV 10 into the water of the basin and prepare the BCV for surface swim. In order to do this, the buoyancy tanks 38 are filled at ambient (atmospheric) pressure, thus providing full floatation for the BCV 10. Next, the BCV 10 will begin descent to the bottom of the basin. To do this, water is allowed to enter tanks until the BCV 10 begins to sink below the surface, representing a minimum-weight setting. Once the BCV 10 has reached the bottom of the basin, the BCV 10 must undergo transition from minimum weight setting to a working-weight setting. To accomplish this, the tanks 38 are allowed to flood completely. After the bottom of the basin has been traversed and cleaned by the BCV 10, the BCV 10 must then begin preparation for surfacing. The first step in this operation is a transition from a working weight setting to the minimum weight setting. During this step, regulated line air is allowed to enter the tanks. When a required tank level is attained, the BCV 10 will begin ascent to the surface. To do this, regulated line air is allowed to completely fill the tanks. As the tanks become fully filled with air the BCV 10 will slowly rise to the surface.

Figure 2:
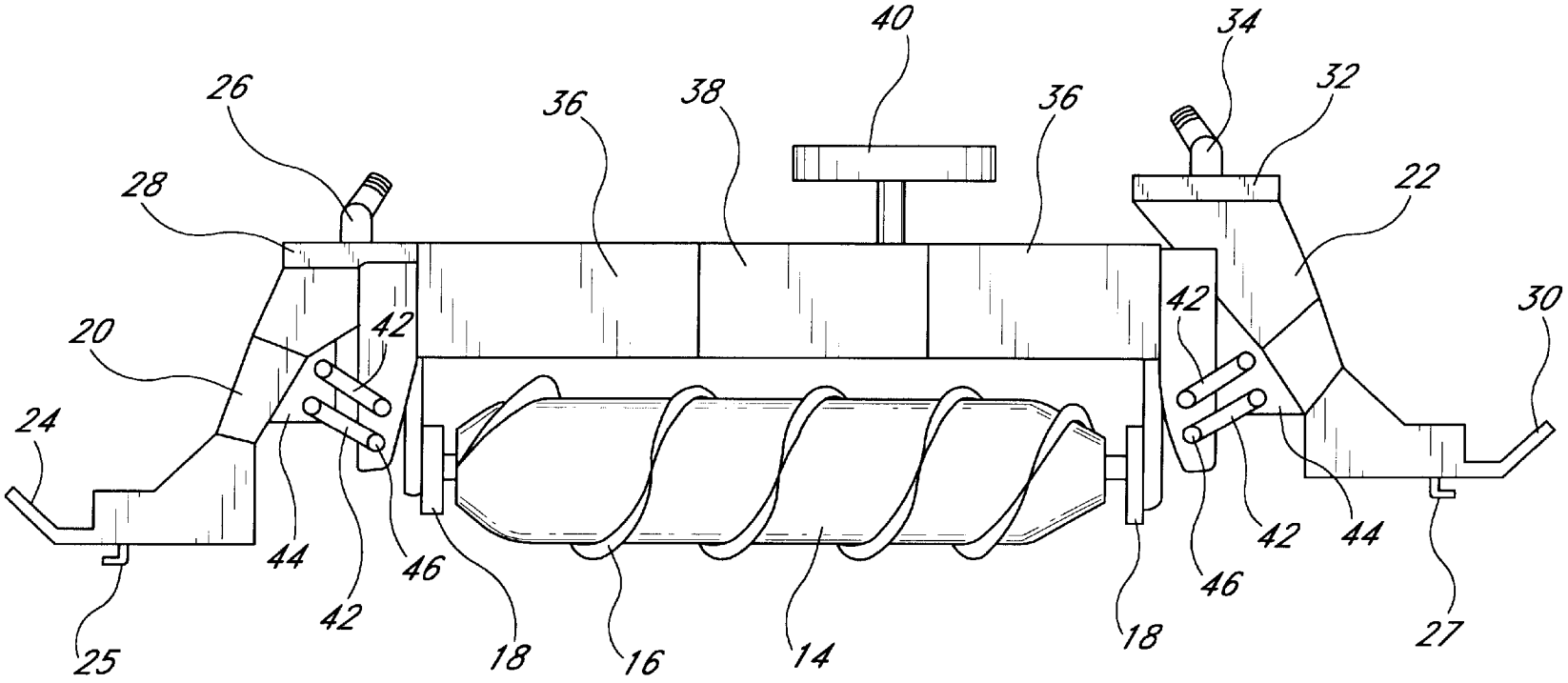
FIG. 2 illustrates a side, elevational view of the basin cleaning vehicle of FIG. 1, taken from a perspective indicated by lines 2—2 of FIG. 1.

Referring to FIG. 2, a side, elevational view of the BCV 10, taken from a perspective indicated by lines 2—2 of FIG. 1, is illustrated. This figure illustrates a side view of many of the components discussed above, such as the archimedean screw rotor 14 having a set of helix blades 16, the first and second vacuum suction hoods 20 and 22, respectively, the fixed buoyancy units 36, the variable buoyancy tank 38, etc. In particular, FIG. 2 illustrates one embodiment of the BCV 10 in which the first and second vacuum suction hoods 20 and 22, respectively, are each attached to the BCV 10 frame or chassis 12 by dual articulating arms 42.

The arms 42 allow the hoods 20 and 22 to ride up or down without rotation and with a minimum of longitudinal translation. However, it is understood that the activation and motion of the hoods 20 and 22 may be controlled by any type of linkage, that is well-known in the art, and which couples the hoods 20 and 22 to the BCV 10. Such linkage should be configured to serve the following three purposes: 1) the hoods 20 and 22 should rise substantially vertically to clear small obstacles; 2) the hoods 20 and 22 should remain substantially level should the rotors 14 sink slightly in weaker areas of the basin bed; and 3) supply and slurry duct hoses attached to the hoods 20 and 22 and to the BCV 10 should remain in a relatively consistent orientation instead of tilting and bending when the hoods 20 and 22 are repositioned. The actuation of the hoods (raising and lowering) 42 may be driven by a respective hood positioning motor (not shown) or controlled by other mechanical, electric or pneumatic systems which are well-known in the art. In one embodiment, an operator can raise and lower the hoods 20 and 22 using a single control switch on a remote control console located on the shore of the basin at the start and end of each cleaning run.

As shown in FIG. 2, the BCV 10 may be fitted with a hood/rake assembly at both ends of its chassis 12. This allows the BCV 10 to clean while moving in either direction. This capability eliminates the need to make course reversal turns at the ends of the cleaning transects, saving time and reducing the associated navigational uncertainty.

Figure 3:
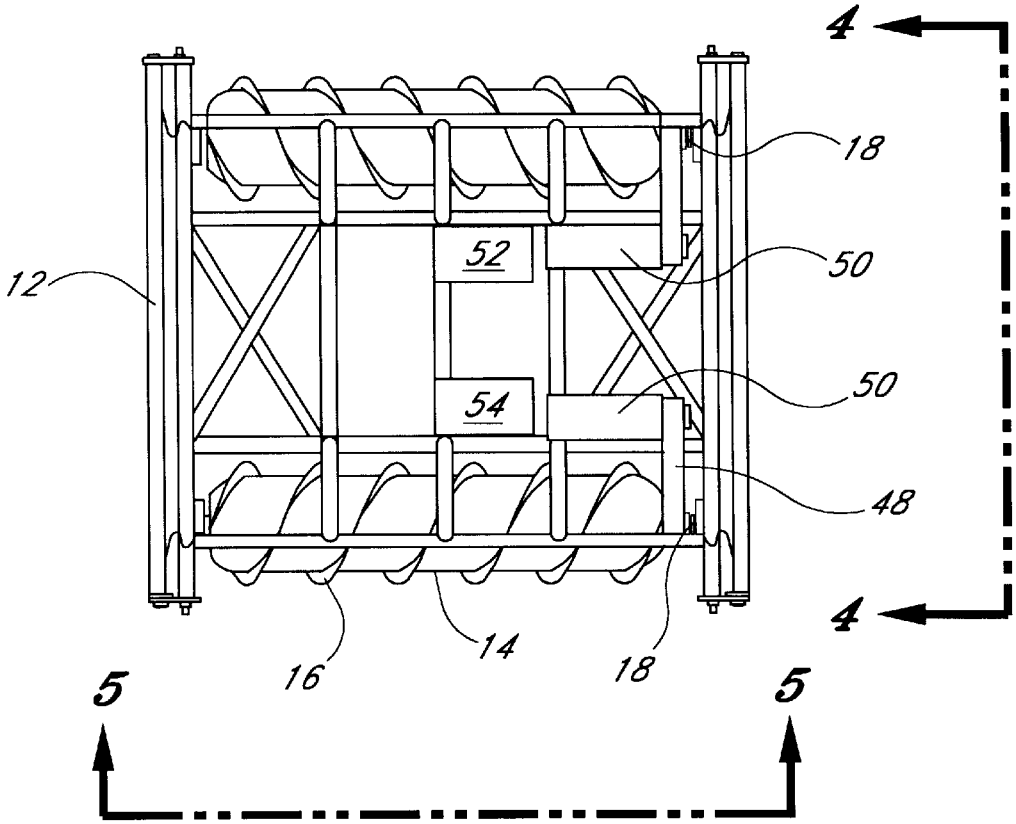
FIG. 3 illustrates a top view of the chassis of the basin cleaning vehicle of FIG. 1 having two archimedean screw rotors attached thereto.

Referring to FIG. 3, a top view of one embodiment of the chassis 12 of the BCV 10 is illustrated. In this embodiment, the chassis 12 is fabricated of welded aluminum structural members. The material and construction facilitates modification, maintenance, and equipment changes, since it is easily drilled and welded. The chassis 12 accommodates all the intended underwater machinery. The dimensions of the chassis 12 and layout of the members are completely driven by the requirements of the other subsystems, the primary components being: the rotors 14 and motors 50 which drive the rotation of a respective rotor 14, a supply pump 52 and a slurry pump 54 (the functionality of these pumps is described in further detail below with respect to FIG. 11) and the hoods, 20 and 22 (FIGS. 1 and 2). The chassis 12 design is also driven by stability requirements. The layout of the heaviest components (pumps and motors) as stated earlier, should be low to balance operation of the BCV 10 while working on and underwater.

As shown in FIG. 3, the rotors 14 are coupled at each end to the chassis 12 by rotor bearing housings 18 which allow each of the rotors 14 to rotate about its longitudinal axis in either direction. The rotor bearing housings 18 are driven by respective drive belts 48 which are in turn driven by a respective drive motor 50, one for each rotor 14. The motors 50 may be DC-servo, electrically powered and electrically controlled. They are variable speed and reversible. In one embodiment, the motors 50 include reducing gears internal to a housing in order to deliver the specified horsepower and torque to the shaft of the respective rotor 14. The rotors 14 turn at a relatively slow speed (up to 30 rpm). However, a geared drive allows the motors 50 to operate at a much more efficient speed (over 1,000 rpm) while still providing slow-speed control when the BCV 10 is operating at minimum speeds.

As illustrated in FIG. 3, the motors 50 are mounted onto the chassis 12 toward the center of the chassis 12. This position keeps the BCV 10 center of gravity (cg) as low as possible while still leaving the motors 50 accessible for service. In one embodiment, the motors 50 are each housed within a pressure-compensated housing. The motors 50 are linked to the rotors 14 by the drive belts 48. In one embodiment, the drive belts 48 are flexible belts, rather than drive chains, so as to reduce the possibility of abrasion by sand. Such external flexible drive belts 48 provide reliability and allow easy maintenance and access when inspection and/or replacement is required.

Figure 4:
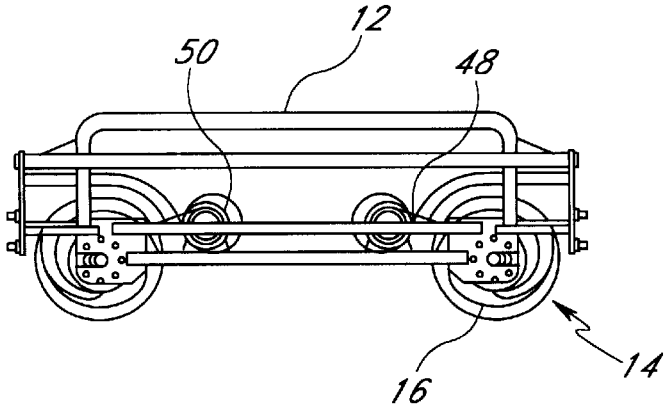
FIG. 4 illustrates an elevational view of one end of the chassis and attached rotors of FIG. 3, taken from a perspective indicated by lines 4—4 of FIG. 3.

FIG. 4 illustrates an elevational, end view of the chassis 12 having rotors 14 and drive motors 50 mounted thereon, taken from a perspective indicated by lines 4—4 of FIG. 3. In one embodiment, the propulsion system, comprising the drive motors 50, the drive belts 48 and the rotors 14, move the BCV 10 at a desired production speed of approximately six to seven inches per second. The BCV 10 can traverse 30 degree basin slopes, either along the streamline or on the contour. On the water surface, auxiliary thrusters with propellers (not shown) allows the BCV 10 to transverse the basin at the surface at a relatively rapid rate.

In one embodiment, the rotors 14 may be equipped with plastic cutting blades (not shown) at each end. This will facilitate penetration of the bottom surface of the basin by the lead helix blade 16 as the rotor 14 turns. The rotors 14 are very similar to commercial augers used in food processing, pharmaceutical and plastics manufacturing. The rotors 14 have two concentric helix blades 16 laterally opposed by 180 degrees to each other.

The rotors 14 may be constructed of aluminum plates, or steel, for example, and welded to internal bulkheads. In one embodiment, the rotors 14 are filled with a closed-cell syntactic foam so as to prevent flooding of the rotors 14 should they become punctured underwater. The rotors 14, when fabricated from steel and filled with foam, have an in-water weight of approximately 518.5 pounds. In air, each rotor 14 weighs approximately 1,419.9 pounds. While heavy, the steel rotors and blades wear longer in the abrasive environment. For these reasons, it is expected that a set of spare rotors to replace worn or damaged units may be maintained at a significantly lower cost than using replaceable blades or more costly materials.

Figure 5:
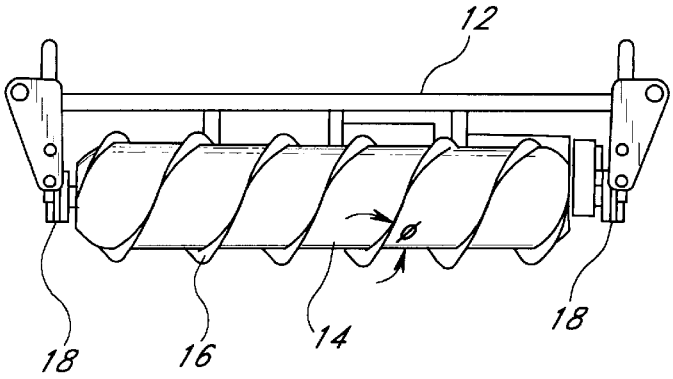
FIG. 5 illustrates a side, elevational view of the chassis and one rotor of FIG. 3, taken from a perspective indicated by lines 5—5 of FIG. 3.

FIG. 5 illustrates an elevational, side view of the chassis 12 of FIG. 3, taken from a perspective indicated by lines 5—5 of that figure. Various parametric analysis were conducted in considering the specifications for the rotors 14. These were done in part to assist in the selection of the appropriate component dimensions, and also to examine the sensitivity of the design to variations in the physical characteristics of the sand medium. These design considerations are similar to those that exists for propellers operated in water, for example, and are well-known in the art. Based on a fixed operational speed of approximately six to seven inches per second, it was discovered that the optimum range for the blade angle (N) for the helix blades 16 is between 15 and 40 degrees. This value, in turn, dictates the rotor rotational speed and the reduction gear specification. While the power requirements would be slightly less at the coarse end of the curve (40 degrees), ease of fabrication is a consideration that warrants selecting a point closer to the fine end (15 degrees). Other factors that effect the geometrical configuration of the rotors 14 are sand density and the friction force provided for the hood and rake system of the BCV 10. Upon consideration of these criteria, in the preferred embodiment, the blade angle was chosen to be 16 degrees and the maximum blade height to be 2.5 inches. These dimensions combine low slip and adaptability to varying substrates with moderate power consumption and ease of manufacture. A summary of the rotor and motor parameters chosen for this embodiment is provided in the table below.

| | Parameter |
|---|---|
| Rotor | |
| Length (ft.) | 7 |
| Diameter (in.) | 18 |
| Blade Angle (degrees) | 16 |
| Rotor Speed (rpm) | 26 |
| Blade Height (in.) | 2.5 |
| Ground Loading Pressure (psi) | 0.2 |
| Motor | |
| Torque (ft-lb) | 2,000 |
| Power (hp) | 10 |
| RPM (through reduction) | 60 max |

The BCV 10 is designed to move with the rotors 14 about 2 inches below the disturbed sand horizon, with a total bottom penetration of about 6 inches (2 inches disturbed by the rake tines 25 (FIGS. 1 and 2), and 4 inches for the rotors 14 and blades 16). When encountering a less stable substrate, the rotor 14 will "submerge" slightly into the sand until again reaching a buoyant equilibrium. With the variable bouancy properly adjusted, the BCV 10 will not sink or become stranded or mired in these areas, as might occur with a tract or wheeled vehicle.

Figure 6:
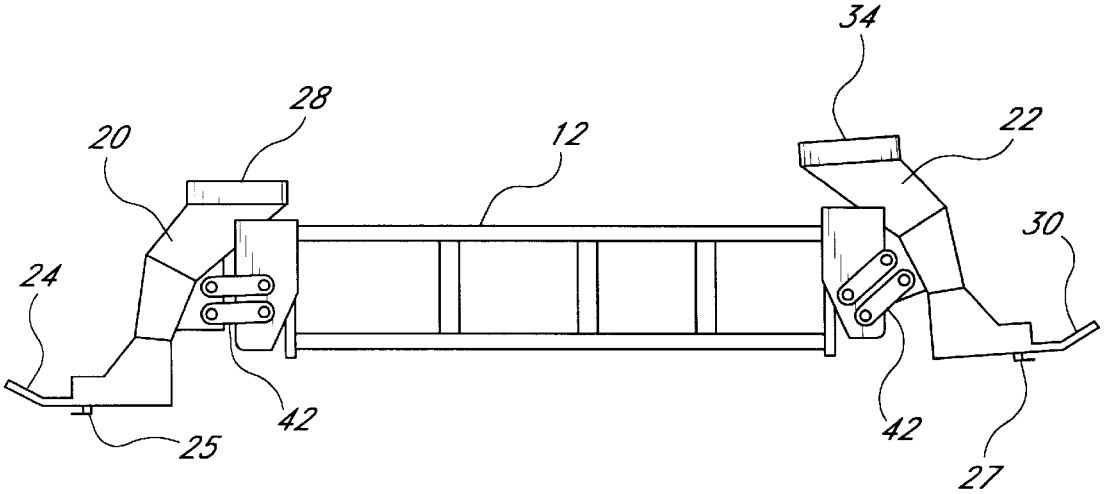
FIG. 6 illustrates a side, elevational view of the chassis of FIG. 3, without the rotors, having first and second vacuum hoods attached thereto, in accordance with one embodiment of the invention.

Referring to FIG. 6, an elevational, side view of the chassis 12, having only the first and second vacuum suction hoods 20 and 22 attached thereto, is illustrated. As discussed above, the hoods 20 and 22 are connected to the chassis 12 by respective sets of dual actuation arms 42 which raise and lower the hoods 20 and 22 depending on which mode of operation the BCV 10 is in. A discussion of hood design and operation is provided below.

Figure 7:
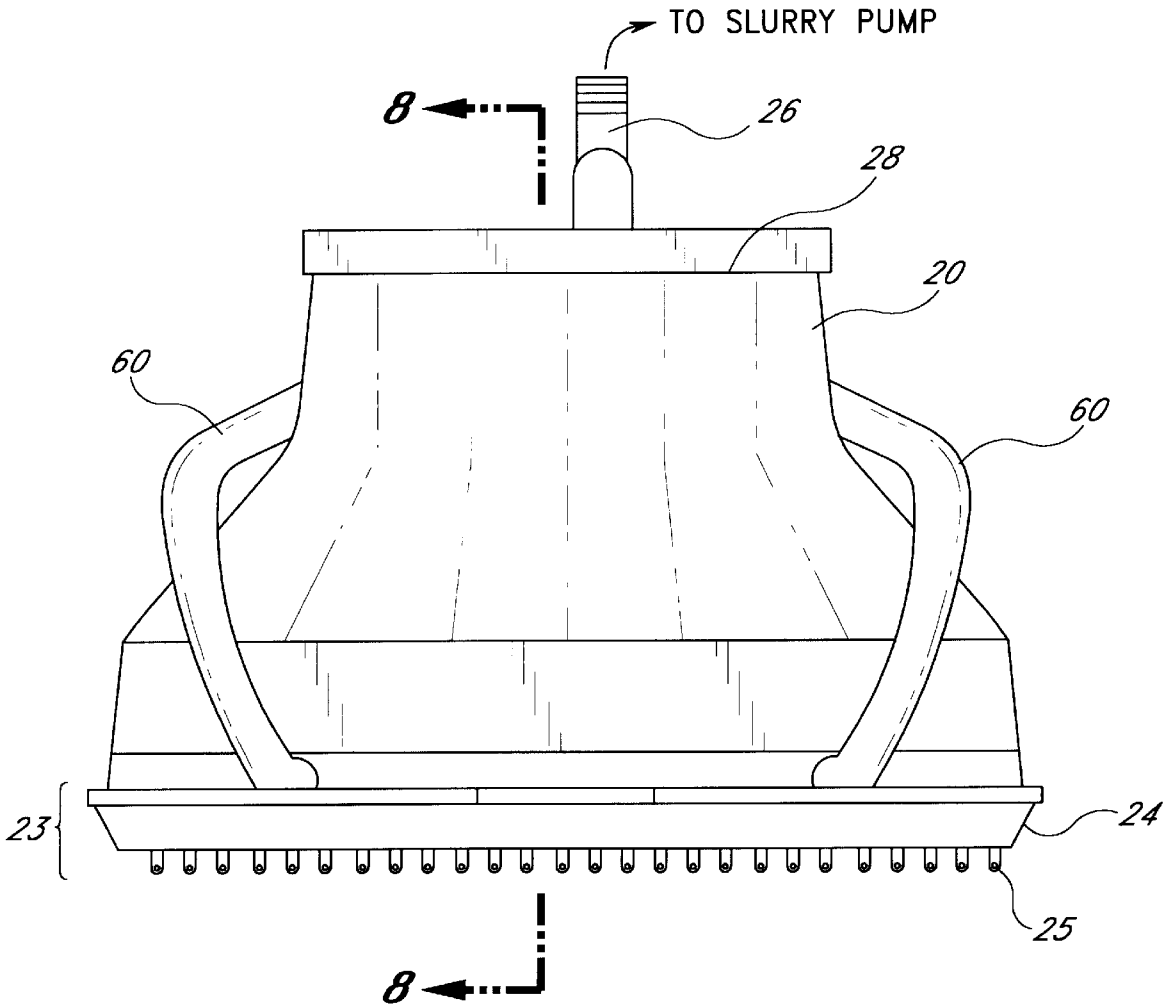
FIG. 7 illustrates a front, elevational view of a vacuum hood assembly, in accordance with one embodiment of the invention.

Referring to FIG. 7, an elevational, front view of the first vacuum suction hood 20 is illustrated. The first hood 20 includes an opening (not shown) at the bottom of the hood 20 that opens into a chamber (not shown) within the hood 20. A rake assembly 23 comprising a wear plate 24 and a plurality of rake tines 25 extending downwardly from the bottom of the rake assembly 23, is attached to a bottom, leading portion of the hood 20. The rake tines 25 penetrate a specified distance (e.g., 2 inches) into the bottom layer of the basin surface to be cleaned. As described in further detail below with respect to FIG. 8*a,* this rake and hood assembly flushes the fine clogging material out of the surface basin sediments, while retaining the desirable, coarser, underlying sand material.

In one embodiment, the rake assembly 23 is eight feet wide and is one of the widest component on the BCV 10. The rake assembly 23 is comprised of a full-width pipe manifold feeding a plurality of individual tines 25 spaced two inches apart and extending into the sand bed. Objects larger than the 2-inch spacing are pushed down into the bottom or off to one side of the rake tines 25, or the rake tines 25 ride over the top of the objects if they are large enough. Objects smaller than two inches may pass between the rake tines 25 and either pass out the back of the hood 20, or if of a low enough density, are drawn up through the hood discharge, through the slurry pump 54 (FIG. 3) and a pipeline coupled to the slurry pump 54, to be deposited on a shore of the basin. Water is pumped from the supply pump 52 (FIG. 3) through supply hoses 60 to the pipe manifold of the rake assembly 23 in spaced intervals over the 8-foot length of the rake. This serves to maintain the internal pressure at a constant level throughout the 8-foot length of the rake assembly 23. The operation of the supply and slurry pumps 52 and 54, respectively, is described in further detail below with respect to FIG. 11.

In one embodiment, the hood 20 is constructed of marine grade aluminum alloy which is of sufficient strength to support the rake assembly 23 and associated water-jet manifolds. The main frame of the hood 20 is a straight-walled chamber of varying cross-sectional area and, as explained in further detail below with respect to FIG. 8*a,* is designed to maintain target upward flow speeds so as to divide the volume of material carried upward (clogging material) from the volume of material which is allowed to fall back down to the basin floor (larger grain sizes than a threshold size).

Figure 8A:
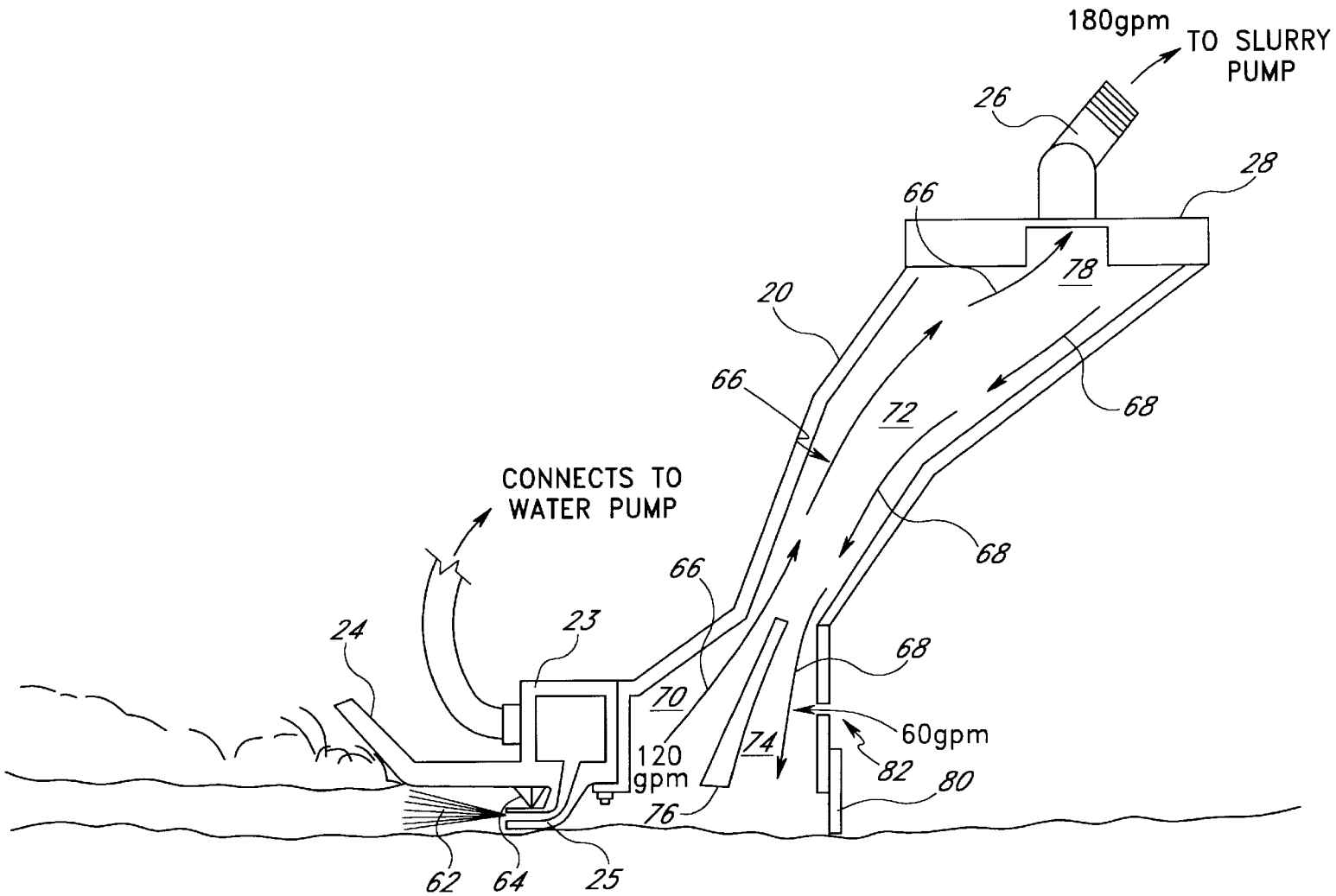
FIG. 8*a* illustrates a cross-sectional view of the vacuum hood assembly of FIG. 7, taken along lines 8—8 of FIG. 7.

Referring to FIG. 8*a,* a cross-sectional, side-elevational view of the hood 20 of FIG. 7, taken along lines 8—8 of that figure, is illustrated. Bolted to the leading, bottom portion of the hood 20 is the rake assembly 23 which includes a replaceable wear plate 24 which protects the rest of the hood as it moves through the bottom layers of the basin by grooming a path to be traversed by the hood 20. The rake tines 25 penetrate the bottom and employ forward directed water jets 62 to fluidize and agitate the bottom sediments. The design of the rake tines 25 allows the water jets to process only the top two inches, for example, of the bottom without disturbing lower strata. In this way, regardless of the permeability or consolidation of the bottom, only the top layer is disturbed and processed. The forward water jets 62 force the finer particles into suspension where they are captured and removed by the controlled flow regime inside the hood 20. In one embodiment the rake tines 25 each include a second nozzle which ejects pressurized water in an upward direction toward the internal chamber of the hood 20. These upward directional jets 64 help propel fluidized particles upwardly so as to suspend them for subsequent suction into the vacuum chamber of the hood 20.

The sediment separation system of the hood 20 is capable of removing fine particles and organic debris while minimizing the removal of large grain sizes. As discussed above, the larger sand particles provide a natural filtration of the basin water as it percolates through the sand into underlying aquifers. Therefore, it is important to not remove substantial amounts of the larger sand particles while cleaning the basin floor. The hood 20 separates sediment grains based on their grain size and settling velocity. The larger, heavier particles will fall toward the bottom surface of the basin at a greater velocity than the smaller, lighter weight particles. The smaller sediment particles are pumped out through the outlet valve 26 by the slurry pump 54 coupled to the valve 26.

The water supply rate provided by the supply pump 52 is based on component tests to determine a minimum flow that will provide complete re-suspension of fine particles and organic debris which are smaller than a predetermined size. The exit rate of "slurry" water is dictated by the slurry pump 54 and is based on the relative settling velocity of various grain sizes.

In designing the geometrical configuration of the hood 20 and determining optimal flow rates within the hood 20, tests were conducted to provide insight into the behavior of particles of various sizes in the hood 20. By determining a target size range for particles which are to be removed and a target minimum size of particles which are not to be removed, flow rates within the hood could be determined so as to provide a desired separation of larger particles and smaller particles. However, it is understood that hood dimensions and flow rates are dependent upon one another as well as the size of the desired particles to be removed. For example, optimal flow rates in a hood of relatively large capacity will not be the same as optimal flow rates in another hood having a smaller capacity. Therefore, there is no single set of hood dimension parameters and flow rates that are optimal for all purposes. Based on sediment and soil samples from the floors of Kraemer and Mini Anaheim basins, located in Orange County, California, it was discovered that natural sands have no measurable material smaller than 63 microns, and typically less than 1% of the sand particles fell in a range between 63 and 75 microns. Their significant size fractions began at coarser than 75 microns with the majority of sand particles in the range of 90 to 106 microns. The fine sediments which constitute the aforementioned clogging layer consisted mostly of particles finer than 63 microns. Based on these facts, removal of the clogging layer, without removing underlying sand particles, would most ideally be accomplished by removing as much as possible of the material finer than 63 microns, removing much smaller amounts of the next larger fractions 63–75 and 75–90 microns, and as little as possible of particles larger than 90 microns. A preferred embodiment hood design, and optimal flow rates for this hood design, have been determined which achieve the desired separation between clogging layer particles and sand particles as typically found in the basins of Orange County. This preferred embodiment is described in further detail below with respect to FIGS. 10–12.

As shown in FIG. 8*a,* the agitated sediments begin to move upward through a first channel section 70 of the hood 20. The first channel section 70 then widens into a second channel section 72 and the upward flow slows to a target speed. As the upward movement of the grains slows, heavier grains are overcome by gravity and begin to fall back to the bottom. Once clear of the main flow stream, these heavier grains pass through a return channel 74 and into the quiescent water behind a separating wall 76 which separates the first channel 70 from the return channel 74. The heavier the grains, the faster they fall out of the flow. Smaller grains are too light to resist the upward flow and are carried upward into a third channel section 78 provided where the size of the hood channel becomes smaller, increasing the flow speed. At this point, all the fine sediment grains that remain in the water flow are hydraulically trapped by the increasing speed and accelerated toward the outlet valve 26.

The larger grain sizes are redeposited on the bottom surface of the basin. The hood 20 encloses the process and confines turbidity to minimize loss of fine sediment particles to the water external to the hood 20. In one embodiment, turbidity is controlled by pumping more water out of the hood 20 than the amount pumped into the hood 20 by the rake tines 25. Turbidity is further controlled by providing external skirts, or flaps, 80, attached to the bottom side and rear perimeters of the hood 20, which prevent a significant amount of water from entering into the chambers of the hood 20 via gaps between the bottom of the hood 20 and the basin floor. The flaps 80 may be made from aluminum sheets or rubber, for example. The difference in the flow rate of water pumped into the hood 20 and the water pumped out of hood 20 is compensated for by a plurality of inlet holes 82 provided on a rear portion of the hood 20. As illustrated in FIG. 8*a*, if the rate of water flow from the rake tines 25 is 120 gallons per minute (gpm), for example, and the rate of slurry flow out of the outlet valve 26 is 180 gpm, the compensation rate of flow into the inlet holes 82 will be 60 gpm. These inlet holes 82 are further illustrated in FIG. 9 which is a rear view of the hood 20 of FIGS. 7 and 8.

The hood 20 is the load-carrying member of the bottom cleaning system. The other parts are attached to the hood 20 with bolted flanges. This modular format allows parts expected to experience similar wear conditions to be replaced without replacing or removing other parts that are expected to wear at a different rate. In one embodiment, the rake assembly 23 is 8 feet wide and is attached to the hood 20 in eight 12-inch sections. This facilitates servicing, in that each section can be removed individually if damaged or worn. This also simplifies the fabrication of the rake assembly 23 because alignment of the rake tines 25 is not as critical. The individual sections of the rake assembly 23 connect to each other at bolted flanges around a bottom perimeter of the hood 20. Any rake assembly 23 section can be removed using hand tools by detaching it from the adjacent section and from the bottom flange of the hood 20. In one embodiment, for strength and wear resistance, each rake assembly 23 section is fabricated of steel.

Figure 8B:
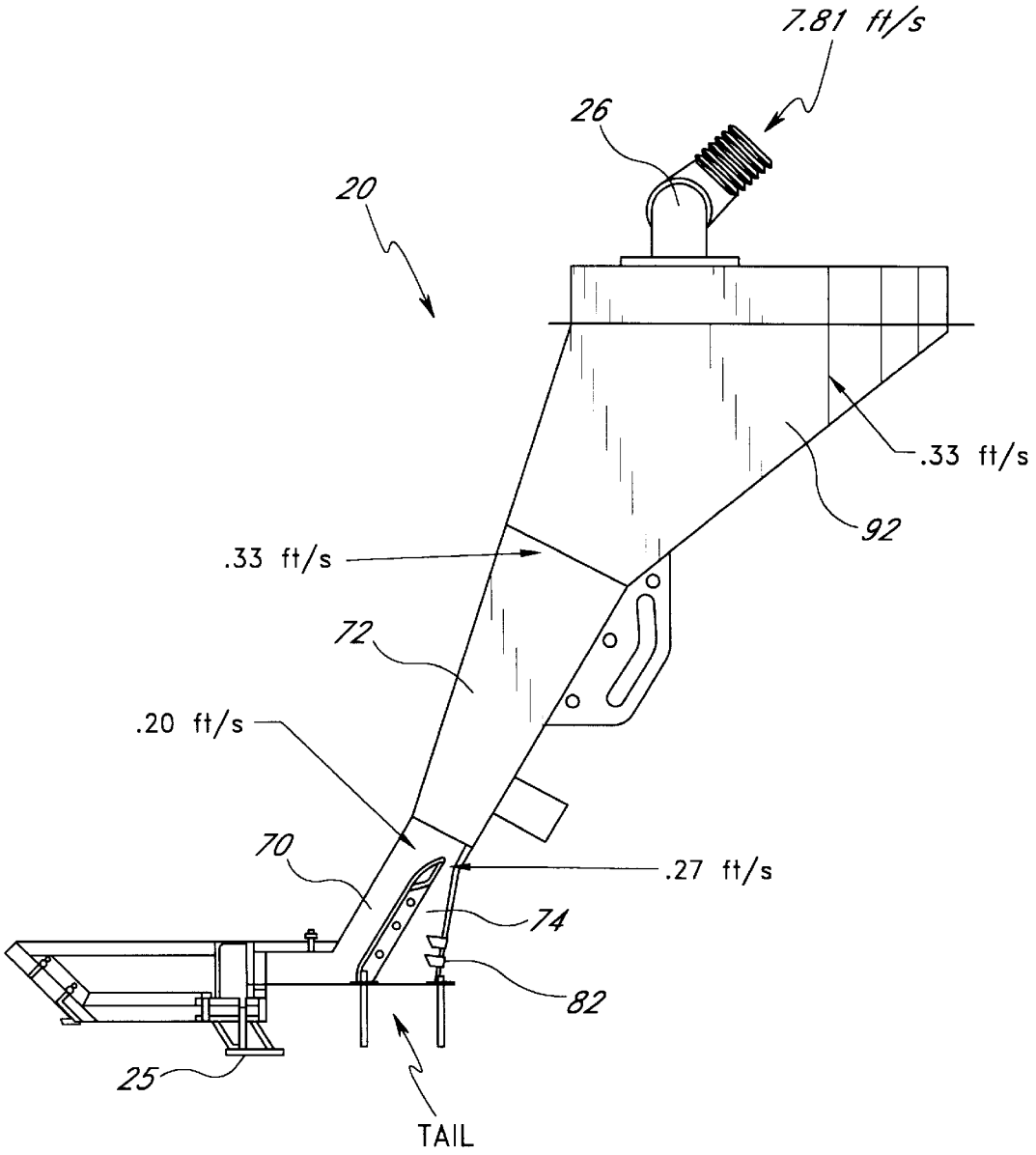
FIG. 8*b* illustrates another cross-sectional view of the vacuum hood assembly of FIG. 7, taken along lines 8—8 of FIG. 7, and which further illustrates relative flow velocities within the vacuum hood.
Figure 9:
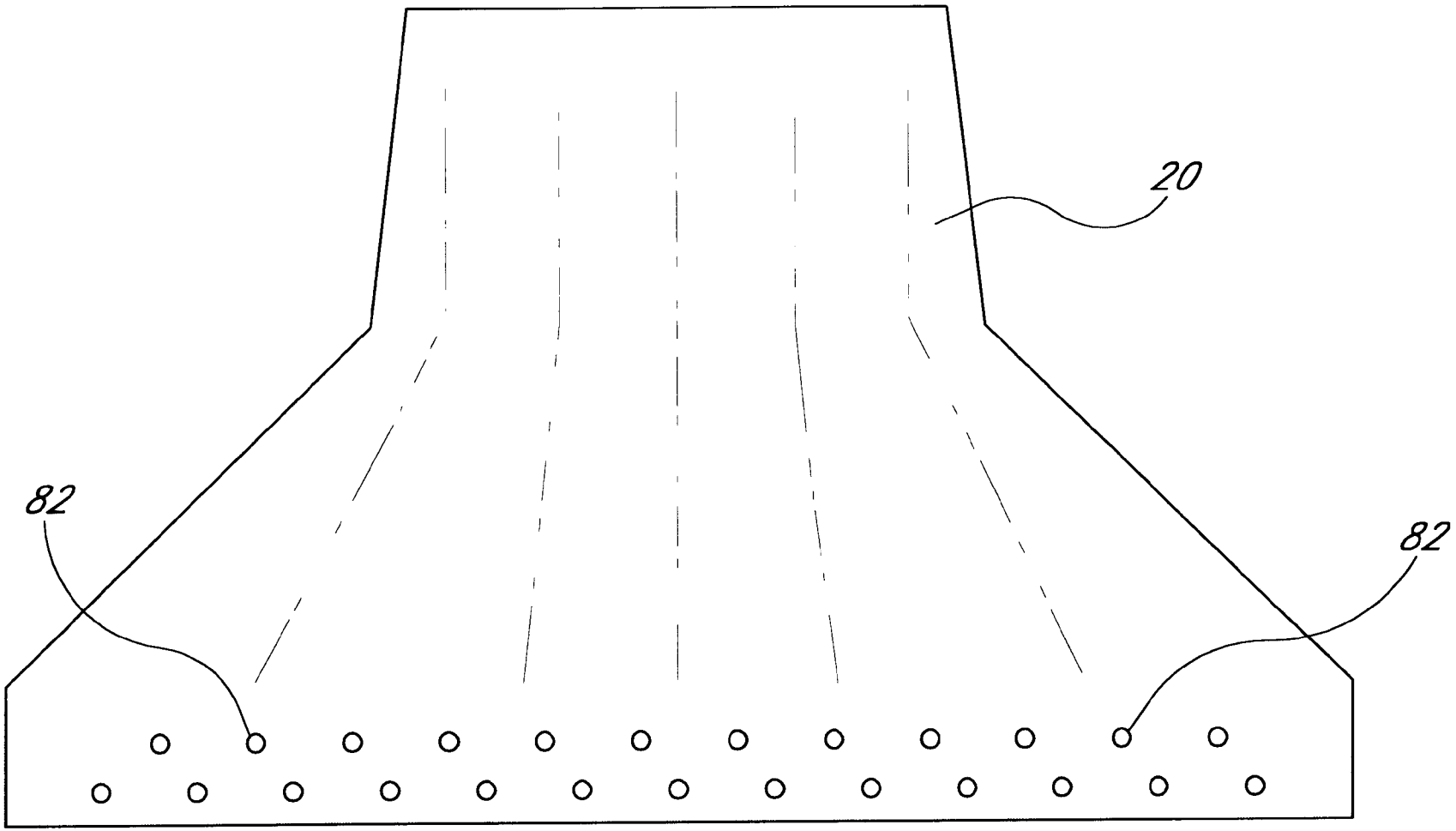
FIG. 9 illustrates a rear, elevational view of the vacuum hood assembly of FIG. 7.

Referring to FIG. 8*b*, another cross-sectional view of the hood assembly 20 of FIG. 7, taken along lines 8—8 of FIG. 7, is shown. As shown in FIG. 8*b*, relative flow velocities vary within the hood due to variations in cross-sectional area and volume within the hood 20. A receiving chamber 70 initially receives an inflow of water ejected out of the rake tines 25, in combination with suspended sediment particles and other materials from a bottom layer of the basin floor, which have been agitated by the water jets from the rake tines 25. With a flow rate of 120 gallons per minute out of the rake tines 25 and into the receiving chamber 70, a flow rate of 60 gpm into the inlet holes 82 and into the return channel 74, and a flow rate of 180 gpm out of the outlet valve 26, flow velocities were calculated at various locations within the hood 20. With these flow rates, a flow velocity of 0.20 feet per second (ft/s) is achieved within the receiving chamber 20. A flow velocity of 0.27 ft/s is achieved in the return channel, and a flow velocity of 0.33 ft/s is achieved within the settling chamber 72 and the outlet ducts 92. These outlet ducts 92 are configured differently than the third channel section 78 (FIG. 8*a*) and are described in further detail below with respect to FIG. 12. As used herein the term "flow velocity" refers to the speed that water is flowing through a given section of the hood 20 at a given time. In contrast, the term "flow rate" refers to the volume of water that is flowing through a given section of the hood 20 at a given time. Tests have shown that by providing the above-described flow rates and flow velocities within the hood 20, good separation between fine sediment particles and the larger underlying natural sand particles of the Orange County water basins may be achieved.

Figure 10:
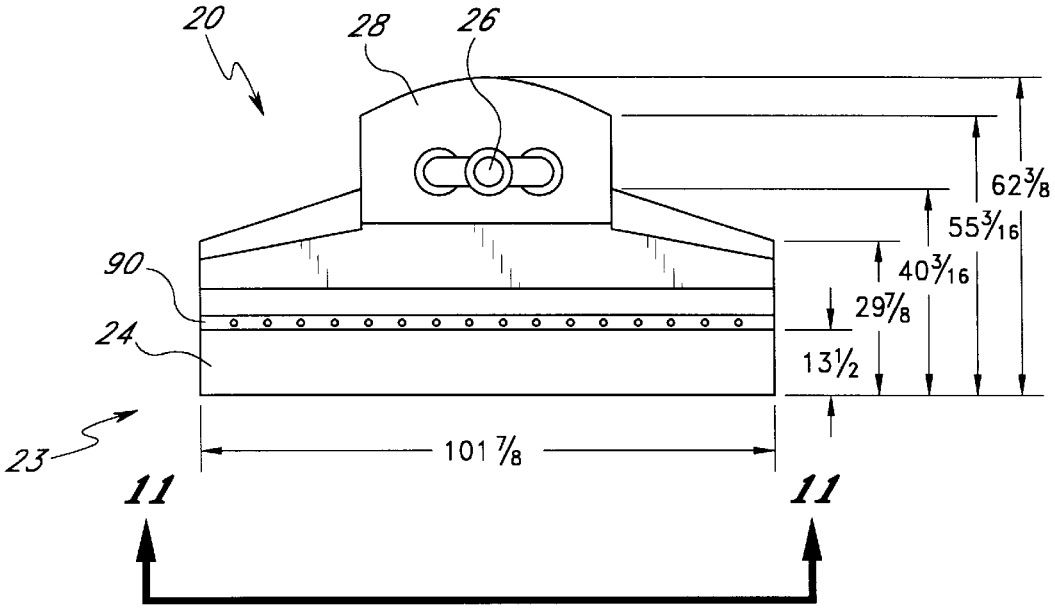
FIG. 10 illustrates a top view, and corresponding dimensions, of a preferred embodiment vacuum hood assembly.

Referring to FIG. 10, a top view of a preferred embodiment hood 20 designed for use by the OCWD, is illustrated. The hood 20 has a rake assembly 23, having a wear plate 24, bolted to a flange 90 of the hood 20 which extends outwardly from a bottom, leading portion of the hood 20. As shown in FIG. 10, the bottom portion of the hood 20 and the wear plate 24 of the rake assembly 23 are approximately 101 and ⅞ inches in width. The wear plate 24 has a depth of approximately 13 and ½ inches, measured from a leading edge of the wear plate 24 to where the wear plate 24 meets the leading, bottom portion of the hood 20. Extending upwardly from the bottom portion of the hood 20 is a middle portion which tapers to meet the top portion of the hood.

At the bottom of the middle portion where it meets the bottom portion of the hood 20, the middle portion extends back from the leading edge of the wear plate 24 a distance of approximately 29 and ⅞ inches from the leading edge of the wear plate 24. At the top of the middle portion, where it meets the top portion, the middle portion extends back from the leading edge of the wear plate 24 a depth of approximately 40 and 3/16 inches. As shown in FIG. 10, the depth of the top portion as measured from the leading edge of the wear plate 24 is approximately 62 and ⅜ inches.

Figure 11:
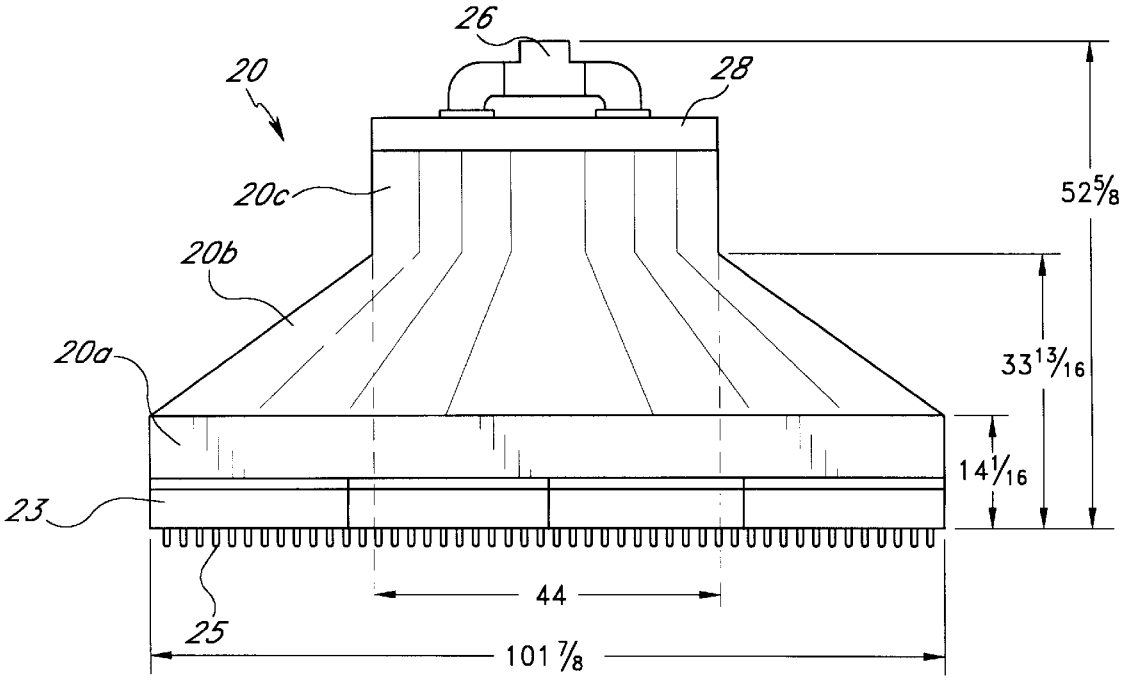
FIG. 11 illustrates a from view of the preferred embodiment vacuum hood assembly of FIG. 10, and corresponding dimensions.

Referring to FIG. 11, a front view of the hood 20 of the FIG. 10, taken from a perspective indicated by lines 11—11 of FIG. 10, is illustrated. As shown in FIG. 11, the width of the bottom portion 20*a* of the hood 20 as well as the width of the wear plate 24 of the rake assembly 23 is approximately 101 and ⅞ inches. The width of the top portion 20*c* of the hood 20 is approximately 44 inches and the width of the middle portion 20*b* tapers from the bottom portion 20*a* to the top portion 20*c*. In this embodiment, the hood 20 stands 52 and ⅝ inches tall. The bottom portion 20*a* is approximately 14 and 1/16 inches tall and the middle portion 20*b* rises from the bottom portion 20*a* to meet the top portion 20*c* at approximately 33 and 13/16 inches from the bottom of the hood 20.

Figure 12:
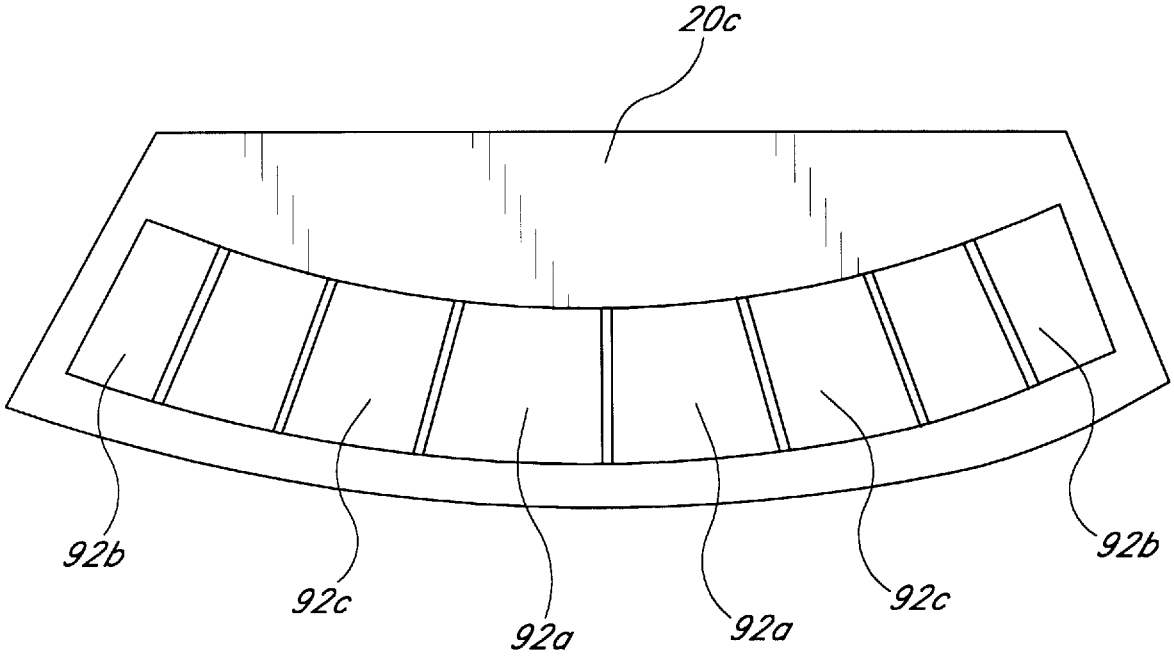
FIG. 12 illustrates a top view of the top internal chamber of the preferred embodiment vacuum hood assembly of FIG. 10.

Referring to FIG. 12, a top view of the hood 20 of FIGS. 10 and 11 is illustrated with the top cover 28 removed. In this embodiment, the internal chamber of the top portion 20*c* of the hood 20 is divided into eight ducts 92 where the center ducts 92*a* have a larger volume than the outer ducts 92*c*. Intermediate ducts 92*b* have an intermediate volume. The reason for this difference in volumes is to equalize the suction force in the ducts 92. When the top cover 28 (FIGS. 10 and 11) is placed onto the top of the hood 20, the suction provided by the two-intake outlet valve 26 (FIGS. 10 and 11) is stronger above the central ducts 92*a* than above the outer, peripheral ducts 92*c*. To compensate for this difference in suction force, the volume of the outer ducts 92*c* is reduced to equalize the flow velocities through the ducts.

With the preferred hood assembly 20 described above with respect to FIGS. 10–12, an optimum flow rate in the hood may be achieved by setting the flow rate of the supply pump 52 (FIG. 3) to pump water through the rake tines 25 at a rate of approximately 120 gallons per minute, setting the slurry pump 54 (FIG. 3) to pump slurry water out of the hood 20 at a rate of approximately 180 gallons per minute, which leaves the inlet apertures 82 (FIG. 9) to compensate for the difference of 60 gallons per minute. However, as mentioned above, it is understood that for different applications it may be necessary to adjust the above-described hood dimensions and flow rates. For example, if the relative sizes of sediment particle and sand particles are significantly different in a basin located outside of Orange County, flow rates through the hood 20 may need to be adjusted to achieve the desired separation between the sediment particles and sand particles.

Figure 13:
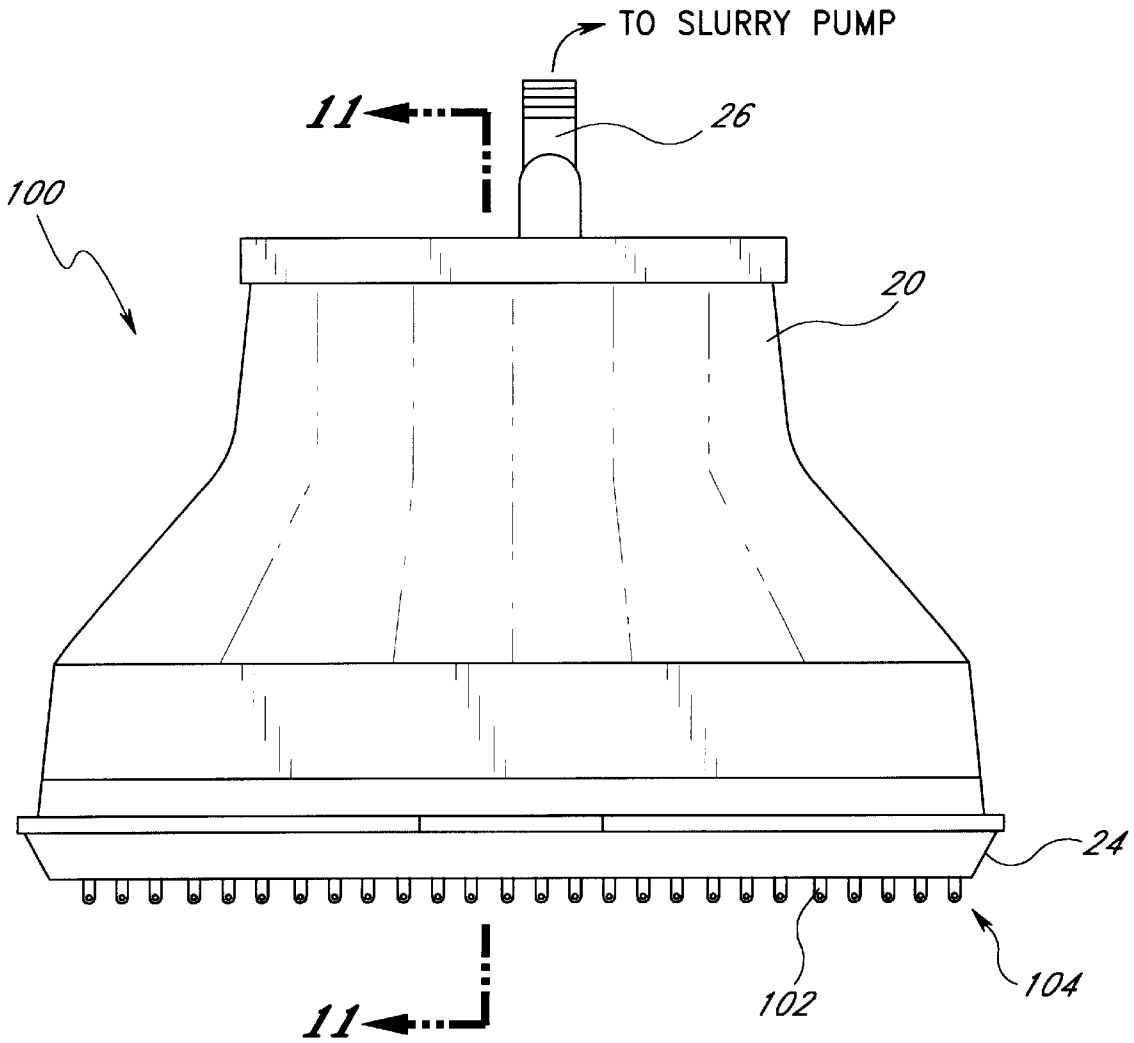
FIG. 13 illustrates a front, elevational view of a vacuum hood assembly in accordance with another embodiment of the invention.

FIG. 13 illustrates another embodiment of a hood assembly 100 having a hood 20 and an outlet valve 26 coupled to a top portion of the hood 20. The hood assembly 100 further includes a wear plate 24 coupled to a leading, bottom portion of the hood 20, for smoothing, or "grooming," a path for the hood 20 to traverse and clean. A rotary agitator 102 having a cylindrical shape is attached laterally across a leading portion of the hood 20, immediately behind the wear plate 24. The rotary agitator 107 includes a plurality of extrusions 104 extending outwardly from its cylindrical surface, for agitating and loosening clogging layer deposits on the basin floor. These extrusions 109 may be formed in any one of a number of different ways. For example, they may be brush bristles, steel spikes, screws, pins, etc. The rotary agitator 107 may function similarly to a rotary brush located on the bottom of a common, household vacuum cleaner, for example, and may be driven by a motor and drive belt assembly which is also similar to that found in most household vacuum cleaners. The rotary agitator 107 may be used in the above-described invention to stir up particles from the basin floor such that the particles may be subsequently suctioned and removed by the hood assembly 20.

Figure 14:
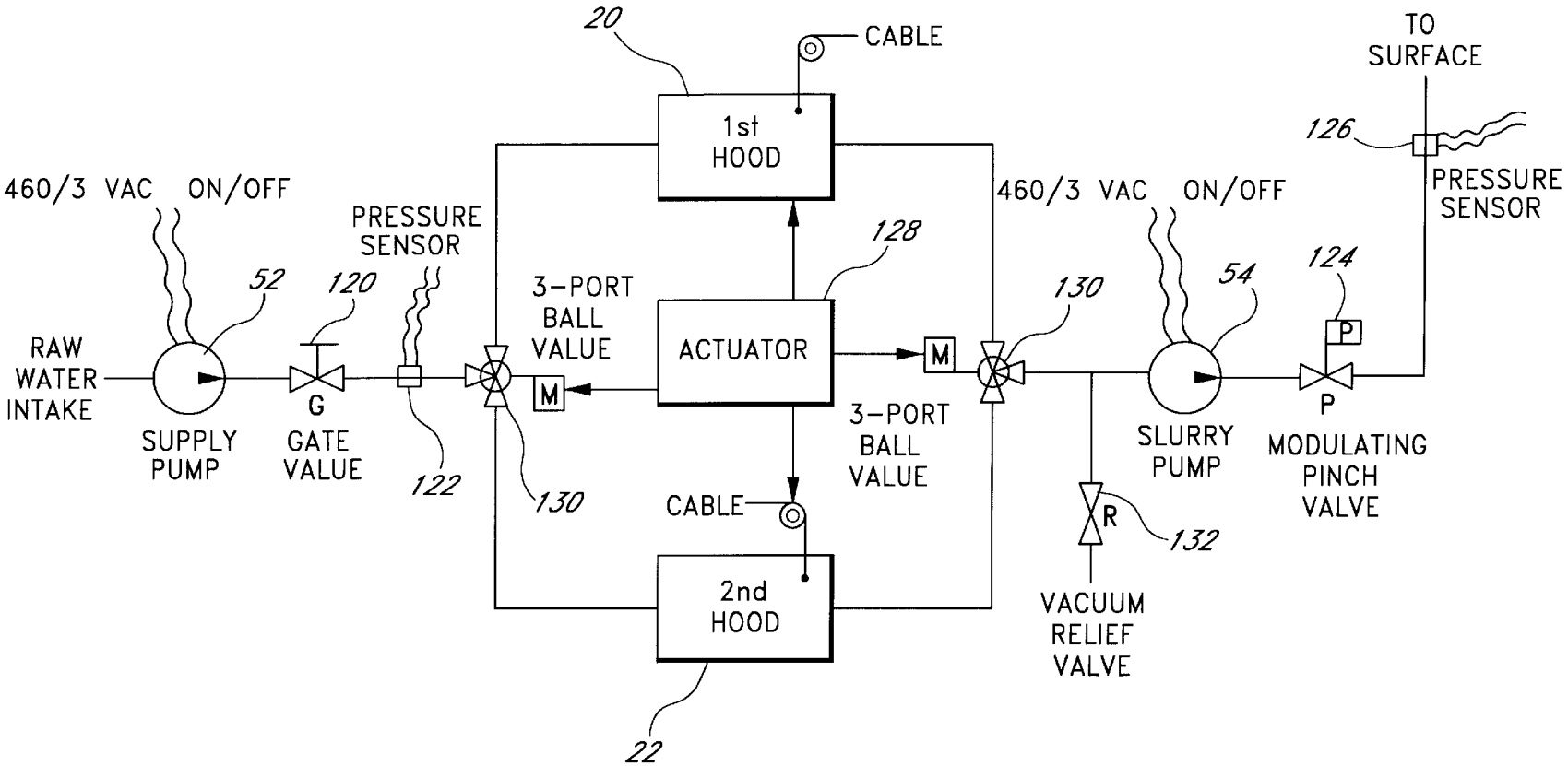
FIG. 14 illustrates a block diagram of a flow control system of the basin cleaning vehicle of FIG. 1, in accordance with one embodiment of the invention.

FIG. 14 illustrates the water and slurry flow process of the BCV 10. There are two electric pumps that drive the flow process: the supply pump 52 that provides clear water to the first and second hoods 20 and 22, respectively, and the slurry pump 54 that evacuates the hoods 20 and 22 and pumps the slurry to the shore.

The supply pump 52 draws in "clear" basin water to supply the rake assemblies 23 (FIGS. 7 and 8) of each of the hoods 20 and 22. The discharge of the supply pump 52 may be manually controlled by a gate valve 120 which adjusts the rake flow rates. Downstream of the gate valve 120 is a pressure sensor 122 which provides an operator information for monitoring supply pump performance. The supply flow passes through a respective hood 20 or 22, where sediment separation and removal takes place. The water is drawn out of the hoods 20 and 22 by the slurry pump 54 which pumps the slurry to the surface. The discharge of the slurry pump 54 has a "pinch valve" 124 designed to adjust the output flow rate from the operator's console. This type of valve does not introduce head losses as does a gate valve, and will not be effected as much by the abrasive nature of the slurry. The pinch valve 124 is used to directly control the flow rate in the hoods 20 or 22. A speed-calibrated pressure sensor 126 downstream of the pinch valve 124 provides data to the operator on the flow rate. Should the operator desire to adjust the flow rate, the operator can actuate a slurry throttle control switch which will, in turn, either slightly charge or purge the pinch valve 124 to modulate the slurry pump 54 output.

The pinch valve 124 is pneumatically operated and electrically controlled. Compressed air is supplied from the same regulated, shore-base supply provided for BCV 10 buoyancy control. As previously mentioned, the slurry pump 54 flows about 20 percent more water volume than the supply pump 52. This is designed to minimize turbidity escaping from the hood assemblies 20 and 22. From a remote control console, the operator can control these two pumps 52 and 54 to be ported to either hood 20 or 22, depending on the direction of BCV 10 travel. This remote control console as well as other components of the BCV 10 navigation and control system are described in further detail below with respect to FIG. 12. Through the remote control console, the operator can drive a rotary actuator 128 which is cable-connected to both hoods 20 and 22 so as to be able to lower one hood while raising the other hood. The actuator 128 has three sequential positions on a travel of 180 degrees: left hood down, both hoods up, and right hood down.

The actuator 128 is also coupled to and operates two 3-way ball valves 130. The ball valves 130 control the routing of the supply and slurry flow connecting the two pumps to either the first or second hoods 20 or 22, respectively, again depending upon the direction of BCV 10 travel. When the actuator 128 rotates fully left, for example, the pumps may be ducted to the first hood 20 and that hood is then lowered to engage and clean the bottom surface of the basin. In a center actuator position (both hoods up), the supply pump 52 sends water to both hoods 20 and 22 and the slurry pump draws water from both hoods, both at reduced flow rates. In the center position the slurry pump 54 still pumps water to the surface, except it will be "clear" water instead of slurry.

When the pumps 52 and 54 are operating, water flows through both rake assemblies 23 at all times (although at half rate when not cleaning the bottom surface). This is designed to preclude the clogging of either rake assembly 23 by sand entering the tines 25, 27 (FIGS. 1 and 2). Both hoods 20 and 22 and both pumps 52 and 54 may be controlled at the operator's remote control console.

The flow system of FIG. 14 may further include a vacuum-relief valve 132 on the intake pipe of the slurry pump 54. When the sequencing ball valves 130 are in transition, there are short periods (several seconds) when no flow is passed through the valves 130. The vacuum-relief valve 132 protects the slurry pump 54 from cavitation erosion and precludes loss of suction and operation outside the designed net pressure suction head envelope. The vacuum-relief valve 132 is capable of passing 200 gallons per minute at a pressure differential of approximately 13 psi, so that should the hood actuator 128 fail with the valves 130 in the intermediate closed positions, the relief valve 132 will protect the slurry pump 54 from cavitation damage for an indefinite period (until the operator can recognize the failure and shut down the pumps).

In one embodiment, the supply pump is an L505 WEDA pump manufactured by the Svedala Pump Company. This is a non-toxic, oil-filled, medium-volume pump built for long life and low maintenance. This 3,500 rpm pump runs on 480 volts ac. The housing is cast aluminum and the impeller is chromium steel. It weighs approximately 90 pounds in air.

In one embodiment, the slurry pump is a Svedala robot sewage pump. This pump is a slower-speed machine (2,900 rpm) designed for less wear in an abrasive environment. By virtue of the open impeller, this pump will pass a 2½ inch solid object without damage. Note that this is larger than the slot size of the rake tines 25 and also larger than a golf ball—the most common foreign object that could be expected to pass through the system.

In one embodiment, the supply-side components (upstream of the hoods) are connected by 3-inch hose stock, which is a polyester-reinforced SBR-covered, flexible hose. The slurry-side components (downstream of the hoods) are connected with 4-inch piping of the same material. The slurry-side flexible hose is a wire-wrapped product selected to remain operable under the vacuum conditions on the intake side of the slurry pump 54. Slurry is pumped from the slurry pump 54 to the surface and finally onto the shore of the basin through an Ultra-High Molecular Weight Polyethylene floating pipeline. The pipeline is comprised of sections 40 feet long, joined by galvanized steel couplers, to form a pipeline having a total length which is sufficient to allow the BCV 10 to reach any point in a given basin with additional slack to facilitate BCV 10 maneuverability. Each segment of pipeline is wrapped in approximately 2 inches of SURLYN to assure positive buoyancy.

Figure 15:
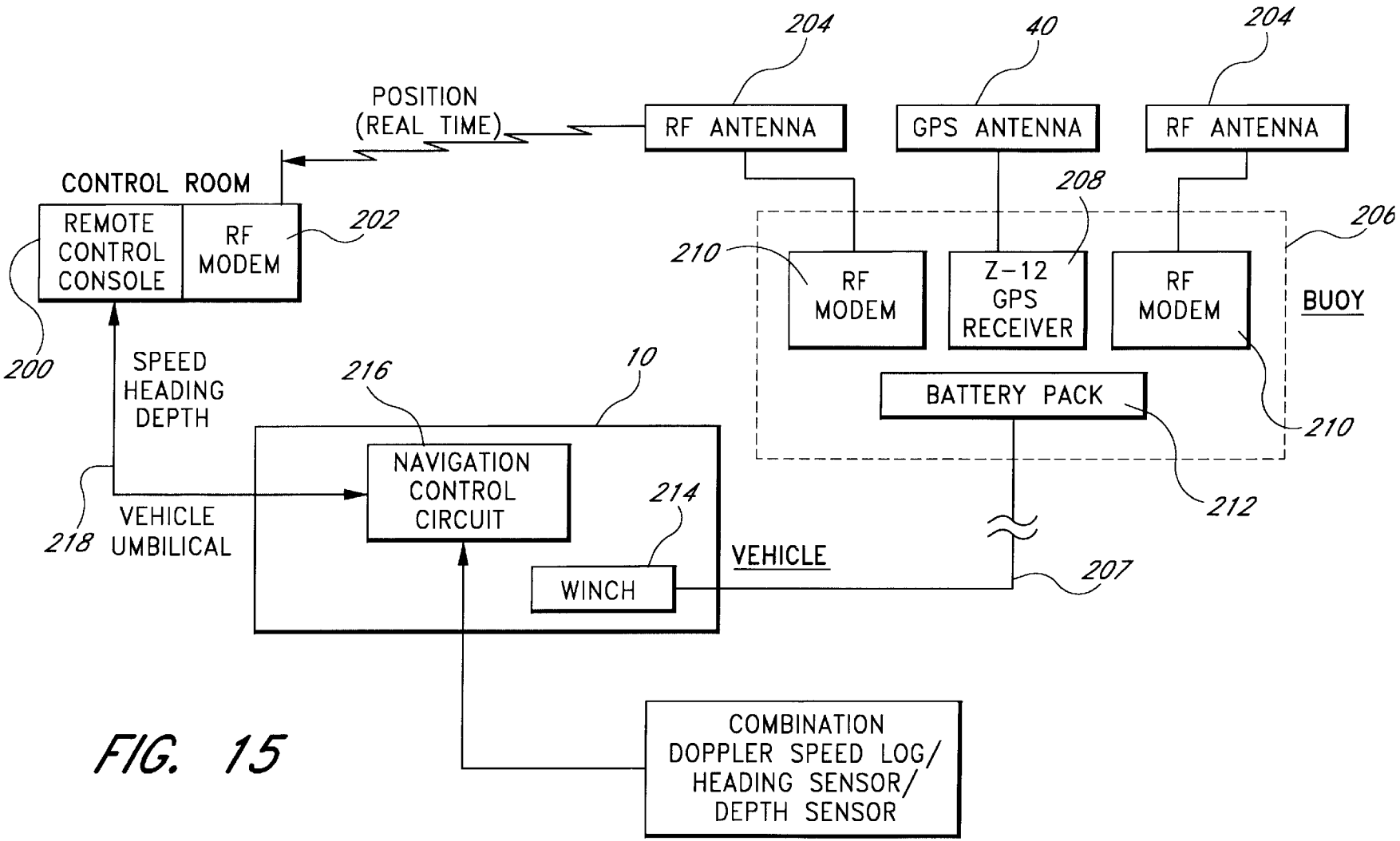
FIG. 15 illustrates a block diagram of a navigational and control system for the basin cleaning vehicle of FIG. 1, in accordance with one embodiment of the invention.

Referring to FIG. 15, a block diagram of a navigation and control system for the BCV 10, is illustrated. Since various methods and systems can be used to control and navigate the BCV 10 in accordance with the invention, it is understood that the invention is not limited to the navigation and control methods and systems described below and illustrated in FIG. 12.

In order to control the movement of the BCV 10, an operator may manipulate a remote control console 200 which is located on the shore of the basin. The console 200 may include a radio frequency (RF) modem 202 which can receive real-time navigational data from one or more RF antennas 204 coupled to the BCV 10. This data may then be displayed to the operator on a display screen (not shown) of the console 200.

In one embodiment, the BCV 10 uses a differential global positioning system (DGPS) to provide navigational data to the control console. The information provided by the navigation system is used to pilot the BCV 10, determine actual bottom speed, sense if the BCV 10 has been stopped unexpectedly, and confirm navigational data. From the remote control console 200, an operator can control or monitor the following parameters: bottom speed, direction, buoyancy and trim, pump operation, rotor rotation, navigational signal quality and production rate.

The navigation and guidance system tracks the location of the BCV 10 during operation and provides real-time BCV 10 speed, heading, and depth information to the operator. The components of this system include a surface buoy 206 that follows closely above the BCV 10 on a taught wire cable 207. The surface buoy 206 includes a navigational receiver 208. The navigation and guidance system further includes a spool winch 214 mounted on the BCV 10 to manage the buoy cable 207. In one embodiment, the BCV 10 further includes an on-board navigation control circuit 216 which provides further navigational data to the remote control module 200 via a direct cable link 218, referred to as the "BCV 10 umbilical cable." The navigation control circuit 216 may include a Doppler speed sensor for providing speed input to the console 200, a flux-gate compass for providing heading information to the console 200, and a pressure-depth transducer for providing depth input to the console 200. A well-known hydrographic survey software package may be loaded onto a computer of the remote control console 200 to process and present these data to the operator.

The navigational system further includes a Global Positioning System (GPS) antenna 40 (also see FIGS. 1 and 2) for receiving position information from a GPS satellite and thereafter providing this information to the remote control console 200 via RF antennas 204. The GPS navigational system is a worldwide standard for military tracking applications, natural resource management, surveying, and other BCV 10 mapping applications. The GPS system receives navigational signals from several satellites orbiting the earth. The satellites are maintained by the US military and provide navigational signals on a continuous basis. These signals are received by the GPS antenna 40 and processed in the GPS receiver 208 to calculate the "exact" position of the antenna 40.

A standard GPS receiver has a positional accuracy on the order of ten meters. This position can be further refined by an advanced GPS receiver/processor until the accuracy is on the order of a few centimeters. This advanced system requires more sophisticated circuitry as well as the use of a separate base-station unit installed over a known position on solid ground. This advanced system is often referred to as "real-time kinematic (RTK)," or differential GPS (DGPS). Because this navigational/tracking technology is well-known in the art a further description need not be provided here.

All of the above-described underwater electronic components of the navigational system are contained in a waterproof pressure housing which is fabricated from hard-anodized, 6061-T6 aluminum. All electrical cable and connectors are high-quality underwater components.

The floating umbilical cable 218 conducts electric power and transmits control signals to the BCV 10. The power components of the BCV 10 include the two electric motors 50 (FIG. 3) for driving the archimedean screw rotors 14; the two electric, fully submersible pumps 52 and 54 (FIG. 3), and the navigational control circuit 216. Most of the components of the BCV 10 are electrically controlled and operated, with the exception of the pneumatic pinch valve 124 (FIG. 11) on the slurry pump 54 discharge and the pneumatically operated vent and flood valves (not shown) on the buoyancy control tanks 36 (FIGS. 1 and 2). The power is distributed and controlled by a power distribution unit (PDU) and travels down the umbilical cable 218 to the BCV 10. The navigational receivers 208, 210 onboard the surface buoy 210 are supplied with power from the battery pack 212.

The above-described navigational and control system, otherwise known as the telemetry system, allows the transmission of both commands and data from the surface to the BCV 10 and the transmission of data from the BCV 10 to the surface. In one embodiment, the operator is provided with: 1) a display of BCV 10 navigational aids; 2) instrumentation readouts and alarms displayed on a VGA monitor; 3) diagnostics to isolate problems between the surface and underwater components; 4) calibration of analog channels via software/keyboard inputs; and 5) control of the BCV 10 tracking, heading and speed.

In one embodiment, the BCV 10 may be operated from a control room, that may be mounted on a flatbed support trailer that transports the entire BCV system. The control room may house the following components: a navigation console used to guide the BCV 10 and display the basin track map; a pilot's console that monitors and controls the various subsystems of the BCV 10; a power distribution unit which monitors and controls all system power; a telemetry computer which accepts inputs from the pilot's console and displays BCV 10 information on the monitor; a ground fault interrupt system (GFI) which monitors electrical lines going to the BCV 10 and shuts down power to the BCV 10 if electrical leakage occurs, thereby protecting personnel and equipment from injury or damage; and a transformer housing which houses step-up transformers that ensure the power received at the BCV 10 is 480 volts after traveling through the resistance of the umbilical cable 218.

In one embodiment, the display of the telemetry computer may display the following parameters: the BCV 10 heading, numerically and/or with a compass strip; the BCV 10 depth; the BCV 10 speed; the BCV 10 pitch and roll; the hood/rake position (e.g., front hood up/rear hood down); supply pump pressure; slurry pump pressure and many other desired parameters and/or alarms.

The movement of the BCV 10, in one embodiment, may be controlled by a joystick on the pilot's console. The joystick is used to control the BCV 10 speed and direction when under manual control. Moving the stick directly forward moves the BCV 10 forward. The farther the joystick is deflected, the faster the BCV 10 moves. Moving the stick back reverses the BCV 10 direction (but not heading) and lateral movement of the joystick results in lateral translation of the BCV 10. Pushing the stick diagonally to the right turns the BCV 10 to the right, and diagonally left turns the BCV 10 to the left.

The pilot's console may further include the following user-interactive controls: a console on/off button which is illuminated when the console is in an on state; a BCV 10 power on/off button which illuminates when the electrical system and the computer on the BCV 10 is in a on state. And similar buttons for controlling the on/off state of the rotors and pumps. The pilot's console may further include the following controls: a 3-position switch which controls which hood is engaged and connected to the system pumps. In a first position of the 3-position switch, the front hood is down and the BCV 10 is configured for forward movement. In a second position of the 3-position rocker switch the rear hood is down and the BCV 10 is configured for reverse motion. In the center position of the 3-position rocker switch, both hoods are up.

The pilot's console also includes a supply pump discharge indicator. The supply discharge pressure is numerically displayed on the pilot's screen. This digital and/or analog (gauge) readout indicates the discharge pressure of the supply pump during operations. During operation, this data may be used to vary the supply rate of "clean" water to the hood/rake assembly. A slurry discharge pressure indicator may also be provided on the pilot's console. The slurry discharge pressure is numerically displayed on the pilot's screen as a digital and/or analog (gauge) readout that indicates the discharge pressure of the slurry pump during operations. This gauge may be used to indicate pressure changes in the slurry pump discharged pipe and control system output.

Telemetry signals and electrical power are conveyed to/from the BCV 10 through the umbilical cable 218. The umbilical cable 218, or tether 218, connects the system computer and the power distribution unit in the control room to the termination housing on the BCV 10. The surface-supply air hose attached to the tether 218 is typically yellow for high visibility. The tether is 1.5 inches in diameter, and weighs 1.7 pounds per foot in air. It is buoyant in fresh water and will float alongside the slurry pipeline during BCV 10 operations. The length of the tether 218 should be sufficient so as to allow the BCV 10 to be used in any one of a select group of basins.

As described above, the invention provides a method and system for cleaning an underwater surface, such as the floor of a basin, and selectively removing particles of a relatively small size while not removing particles of a relatively larger size. This method and system includes a submersible cleaning vehicle which is controlled to traverse an underwater floor and selectively remove the fine sediment particles without removing a substantial amount of the underlying natural sand and gravel.

The invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed is:

1. A system for cleaning sediment from the sandy, underwater floor of a water seepage basin, comprising:

a submersible, self-propelled apparatus for traversing the underwater floor;

a vacuum hood, coupled to the apparatus, having a flow cross sectional area to suction sediment from the underwater floor; and a pump, coupled to the hood, for providing a water flow rate to the hood;

said cross sectional area of said vacuum hood and said water flow rate of said pump coordinating to separate sediment from sand particles suctioned from the underwater floor.

2. The system of claim 1 further comprising a rotary agitator, coupled to said vacuum hood and laterally located along a bottom, front portion of said vacuum hood, said rotary agitator agitating and loosening sediment particles resting on the underwater floor.

3. The system of claim 1 further comprising a second vacuum hood coupled to an opposite end of said submersible vehicle in relation to said vacuum hood.

4. The system of claim 1 further comprising an agitator for loosening said sediment particles resting on the underwater floor.

5. A system for cleaning sediment from the sandy, underwater floor of a water seepage basin, comprising:

a submersible, self-propelled apparatus for traversing the underwater floor;

a vacuum hood, coupled to the apparatus, for selectively suctioning sediment in preference to sand particles from the underwater floor;

a pump, coupled to the hood, for providing a suction force to the hood;

a navigational system, coupled to the submersible apparatus, for indicating the location of the apparatus; and a remote control console, coupled to the navigational system and the submersible apparatus, for receiving apparatus position data from the navigational unit and controlling the movement of the apparatus.

6. The system of claim 5 wherein said navigational system is a global positioning system.

7. The system of claim 5 further comprising at least one buoyancy control tank, coupled to the submersible apparatus, for controlling the buoyancy of the apparatus, wherein air and water inflow and outflow for the tank is controlled by said remote control console.

8. The system of claim 5 wherein said submersible apparatus includes two archimedean screw rotors for providing forward, reverse and lateral motion to the apparatus and wherein said remote control unit controls the rotation speed and the direction of rotation of each of said rotors.

9. A system for cleaning sediment from the sandy, underwater floor of a water seepage basin, comprising:

a submersible, self-propelled apparatus for traversing the underwater floor;

a vacuum hood, coupled to the apparatus, for selectively suctioning sediment in preference to sand particles from the underwater floor;

a pump, coupled to the hood, for providing a suction force to the hood;

a second pump, coupled to the submersible apparatus; and a plurality of rake tines, coupled to said second pump and laterally dispersed across said vacuum hood, wherein said plurality of rake tines extend to penetrate a specified distance into a bottom layer of the underwater floor, and wherein said plurality of rake tines eject pressurized water received from the second pump to fluidize fine sediment particles from the underwater floor.

10. The system of claim 9 wherein said plurality of rake tines each eject pressurized water in both a forward and upward direction, wherein the pressurized water moving in the forward direction initially loosens and fluidizes said fine sediment particles and the pressurized water moving in the upward direction propels the fine sediment particles upwardly toward a chamber within the said vacuum hood.

11. The system of claim 10 further comprising:

a flow-adjust valve for adjusting the output flow rate of said pump to adjust an output flow rate of said vacuum hood; and a second flow-adjust valve for adjusting the output flow rate of said second pump, thereby adjusting a flow rate of said plurality of rake tines.

12. The system of claim 11 further comprising:

a pressure sensor, coupled to said flow-adjust valve, for providing an indication of said output flow rate of said pump; and a second pressure sensor, coupled to an output of said second flow-adjust valve, for providing an indication of said output flow rate of said second pump.

13. The system of claim 9 further comprising:

a first side flap, extending downwardly from a first side peripheral, bottom edge of said vacuum hood to substantially seal a first side gap between the first side peripheral, bottom edge of said vacuum hood and the underwater floor;

a second side flap, extending downwardly from a second side, opposite the first side, peripheral, bottom edge of said vacuum hood so as to substantially seal a second side gap between the second side peripheral, bottom edge of said vacuum hood and the underwater floor; and a rear flap, extending downwardly from a rear peripheral, bottom edge of said vacuum hood so as to substantially seal a rear gap between the rear peripheral, bottom edge of said vacuum hood and the underwater floor, wherein the first and second side flaps and the rear flap prevent water from flowing into the bottom of said vacuum hood from either the sides or the rear of the first hood.

14. The system of claim 13 further comprising:

a plurality of inlet apertures located on a rear wall of said vacuum hood for providing a compensating inflow of water into said chamber of the first hood; and wherein a flow rate provided by said pump is greater than the flow rate provided by said second pump and the compensating inflow of water provided by the plurality of inlet apertures compensates for the difference in flow rates provided by said pump and said second pumps.

15. A system for cleaning sediment from the sandy, underwater floor of a water seepage basin, comprising:

a submersible, self-propelled apparatus for traversing the underwater floor;

a vacuum hood, coupled to the apparatus, for selectively suctioning sediment in preference to sand particles from the underwater floor; wherein said vacuum hood encloses a chamber, the chamber comprising:

a receiving section for initially receiving suctioned particles from the underwater floor;

a return section, located immediately behind the receiving section, for allowing particles to fall to the underwater floor, wherein a separation wall, laterally disposed across an internal, bottom portion of said vacuum hood separates said receiving section and said return section;

a settling section, located immediately above the receiving section and the return section, wherein heavier particles fall from the settling section to the return section and settle back onto the underwater floor;

an outlet valve coupled to said first pump; and an exit section, located immediately above the settling section, wherein any suspended particles reaching the exit section are propelled through the exit section to an outlet valve; and a pump, coupled to the hood, for providing a suction force to the hood.

16. A system for clearing sediment from the sandy, underwater floor of a water seepage basin, comprising:

a submersible, self-propelled apparatus for traversing the underwater floor;

a vacuum hood, coupled to the apparatus, for selectively suctioning sediment in preference to sand particles from the underwater floor;

a pump, coupled to the hood, for providing a suction force to the hood; and a wear plate, coupled to a leading, bottom portion of said vacuum hood, for smoothing a path to be traversed by said vacuum hood.

17. A system for cleaning sediment from the sandy, underwater floor of a water seepage basin, comprising:

a submersible, self-propelled apparatus for traversing the underwater floor;

a vacuum hood, coupled to the apparatus, for selectively suctioning sediment in preference to sand particles from the underwater floor;

a pump, coupled to the hood, for providing a suction force to the hood;

a second vacuum hood coupled to an opposite end of said submersible vehicle in relation to said vacuum hood; and a valve for selectively coupling said first pump selectively to said first and second vacuum hoods.

18. A system of claim 17 further comprising:

a second pump, coupled to the submersible vehicle;

a first plurality of rake tines, selectively coupled to said second pump and to said vacuum hood so as to be laterally dispersed across a bottom, leading portion of the first hood; and a second plurality of rake tines, selectively coupled to said second pump and to said second vacuum hood and laterally dispersed across a bottom, leading portion of said second hood.

19. The system of claim 18 further comprising a second three-way valve, coupling said second pump to said first and second plurality of rake tines.

20. An underwater cleaning vehicle, comprising:

a chassis having a front portion, a rear portion and two side portions;

an archimedean screw rotor rotatably coupled to the chassis for providing mobility to the vehicle; and a first vacuum hood, coupled to the chassis.

21. The underwater cleaning vehicle of claim 20 further comprising:

a first pump, coupled to said vacuum hood, for providing a suction force to said vacuum hood;

a first plurality of rake tines, coupled to said vacuum hood and laterally dispersed across a bottom, leading portion of said vacuum hood; and a second pump, coupled to said plurality of rake tines, for providing pressurized water to the said plurality of rake tines.

22. A system for cleaning an underwater floor, comprising:

a submersible, self-propelled vehicle for traversing the underwater floor;

an enclosure, coupled to said submersible vehicle, for containing sediment particles from the underwater floor;

a pump attached to said enclosure for selectively removing sediment in preference to sand from said enclosure;

a navigation system for indicating the location of the vehicle; and a steering system for controlling the movement of the vehicle.

23. A system for cleaning an underwater floor, comprising:

a submersible, self-propelled vehicle for traversing the underwater floor;

an enclosure, coupled to said submersible vehicle, for containing sediment particles from the underwater floor;

a pump attached to said enclosure for selectively removing sediment in preference to sand from said enclosure; and a plane positioned to smooth a path to be traversed by said submersible vehicle.

24. A system for cleaning an underwater floor, comprising:

a submersible, self-propelled vehicle for traversing the underwater floor;

an enclosure, coupled to said submersible vehicle, for containing sediment particles from the underwater floor;

a pump attached to said enclosure for selectively removing sediment in preference to sand from said enclosure;

a second enclosure coupled to an opposite end of said submersible vehicle in relation to said first enclosure;

a first agitator coupled to said enclosure for fluidizing said sediment particles resting on the underwater floor; and a second agitator coupled to said second enclosure for fluidizing said sediment particles resting on the underwater floor.

25. An underwater cleaning vehicle, comprising:

a drive system for providing mobility to the vehicle on an underwater floor;

a first vacuum for suctioning sediment particles from the basin floor;

a second vacuum for suctioning sediment particles from the basin floor; and a vacuum control to selectively operate said first and second vacuum in accordance with the direction of travel of said vehicle.

26. The underwater cleaning vehicle of claim 25 further comprising:

a first pump coupled to said first and second vacuums to draw fluid therefrom;

a first agitator coupled to said first vacuum for ejecting pressurized water onto the underwater floor and fluidizing said sediment particles on the underwater floor;

a second agitator coupled to said second vacuum for ejecting pressurized water onto the underwater floor and fluidizing said sediment particles on the underwater floor; and a second pump coupled to the first and second agitators for providing said pressurized water to said first and second agitators.

27. The underwater cleaning vehicle of claim 25 further comprising a buoyancy control chamber on said vehicle.

28. A method of cleaning an underwater floor, comprising:

submerging a vehicle such that it comes to rest on the underwater floor;

directing the vehicle to traverse the underwater floor;

selectively suctioning sediment particles from the underwater floor while leaving sand and gravel in place as the vehicle traverses the floor; and providing a suction force to the vehicle.

29. The method of claim 28 wherein said act of selectively suctioning comprises removing substantial amounts of particles smaller than a predetermined size from the floor while not removing substantial amounts of particles larger than said predetermined size from the floor.

30. The method of claim 29 wherein said act of removing substantial amounts of particles smaller than a predetermined size from the floor while not removing substantial amounts of particles larger than the predetermined size from the floor, comprises:

directing particles, via a vacuum suction force, into a first chamber of a vacuum hood, coupled to said vehicle;

subsequently directing said particles into a second chamber of said vacuum hood, wherein gravity forces said particles larger than the predetermined size to fall back to the underwater floor via a return channel located immediately below the second chamber, at a bottom, rear portion of said vacuum hood; and subsequently directing any remaining particles which have not fallen back to the underwater floor to a third chamber having a volume smaller than the second chamber such that there is an increased flow velocity in said third chamber compared to the second chamber.

31. The method of claim 28 wherein said act of directing said vehicle comprises:

receiving positional data from an on-board navigational system located on the vehicle;

displaying information derived from the positional data on a display screen of a remote navigational system located on a shore to an operator viewing the display screen; and controlling the movement of the vehicle underwater, via a remote control console manipulated by the operator.

32. The method of claim 28 further comprising fluidizing fine sediment particles which constitute a top layer of said underwater floor.

33. The method of claim 32 wherein said act of fluidizing comprises ejecting pressurized water below said top layer.

34. The method of claim 28 further comprising agitating and loosening sediment particles resting on the underwater floor.

35. The method claim 28 further comprising:

activating a first vacuum hood, coupled to a front portion of said vehicle, for suctioning sediment particles from the underwater floor when the vehicle is moving in a forward direction; and activating a second vacuum hood, coupled to a rear portion of the vehicle, for suctioning sediment particles from the underwater floor when the vehicle is moving in a reverse direction.

36. The method of claim 28 further comprising controlling the buoyancy of said vehicle.

37. Apparatus for removing sediment from the submerged granular walls of a percolation source of an underground aquifier, comprising:

an agitator designed to disrupt a surface layer of said submerged granular walls; wherein said agitator comprises at least one water jet member which ejects pressurized water onto said surface layer of said submerged granular walls, thereby disrupting said sediment and material within the surface layer, a separator which cooperates with said agitator to divide said sediment from the material of said granular walls; and a collector which cooperates with said separator to remove divided sediment.

38. Apparatus for removing sediment from the submerged granular walls of a percolation source of an underground aquifier, comprising:

an agitator designed to disrupt a surface layer of said submerged granular walls, a separator which cooperates with said agitator to divide said sediment from the material of said granular walls, wherein said separator comprises a vacuum hood having a chamber therein, wherein said sediment and material of said granular walls enters into said vacuum hood and are separated by an upward flow which propels smaller sediment particles upwardly toward an outlet valve of the hood and by gravity which forces larger material particles to fall toward said submerged granular walls; and a collector which cooperates with said separator to remove divided sediment.

39. The apparatus of claim 38 wherein said chamber comprises:

an entrance section for receiving said sediment and material from said surface layer;

a settling section, located above the entrance section, for receiving the sediment and material from the entrance section, wherein the settling section has a volume greater than a volume of the entrance section, such that a flow velocity within the settling section is less than a flow velocity within the entrance section, and wherein particles larger than said predetermined size are separated by gravity from particles smaller than the predetermined size in the settling section;

a return section, located below the settling section, wherein said particles larger than said predetermined size fall through the return section toward said submerged granular walls; and an exit section, located above the settling section, for receiving any remaining particles from the settling section and guiding the remaining particles to said first pump.

40. Apparatus for removing sediment from the submerged granular walls of a percolation source of an underground aquifier, comprising:

an agitator designed to disrupt a surface layer of said submerged granular walls;

a separator which cooperates with said agitator to divide said sediment from the material of said granular walls; and a collector which cooperates with said separator to remove divided sediment, wherein said collector comprises a first pump coupled to a vacuum hood having a chamber in which said sediment is divided from said material of said granular walls, wherein the first pump suctions the divided sediment from the chamber.

41. The apparatus of claim 40 further comprising a second pump, coupled to said vacuum hood, for pumping water into said chamber, wherein a first flow rate provided by said first pump is greater than a second flow rate provided by the second pump, and wherein said vacuum hood further comprises at least one inlet aperture for providing a compensating inflow rate.

42. A method of removing clogging material from the walls of an underwater basin without removing other material, the method comprising:

agitating said clogging material and other material from said walls so as to suspend them in water; and selecting said clogging material from said other material from said walls based on grain size to permit selective removal of said clogging material.

43. The method of claim 42 wherein said act of agitating comprises ejecting pressurized water onto a surface of said walls, thereby disrupting said clogging material and other material from the wall.

44. The method of claim 42 wherein said act of selecting said clogging material from said other material comprises separating larger particles from smaller particles in a vacuum hood.

45. The method of claim 44 wherein said act of separating larger particles from smaller particles comprises:

suctioning said clogging material and said other material from a basin wall into an entrance chamber of said vacuum hood;

directing said clogging material and said other material from the entrance chamber to a settling chamber within the vacuum hood, wherein a volume of the settling chamber is greater than a volume of the entrance chamber such that a flow velocity within the settling chamber is less than a flow velocity within the entrance chamber, and wherein particles larger than a predetermined size are separated by gravity from particles smaller than the predetermined size in the settling chamber;

providing a return channel, located below the settling chamber, wherein said particles larger than said predetermined size fall through the return channel toward said basin wall; and suctioning any remaining particles through an exit channel, located above the settling chamber.

* * * * *